US007163785B2

(12) United States Patent
Kondo et al.

(10) Patent No.: US 7,163,785 B2
(45) Date of Patent: Jan. 16, 2007

(54) SILVER HALIDE PHOTOSENSITIVE MATERIAL AND IMAGE FORMING METHOD THEREFOR

(75) Inventors: Toshiya Kondo, Hino (JP); Koichiro Kuroda, Hino (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 23 days.

(21) Appl. No.: 10/534,608

(22) PCT Filed: Nov. 20, 2002

(86) PCT No.: PCT/JP02/12113

§ 371 (c)(1),
(2), (4) Date: May 11, 2005

(87) PCT Pub. No.: WO2004/046812

PCT Pub. Date: Jun. 3, 2004

(65) Prior Publication Data

US 2006/0057509 A1 Mar. 16, 2006

(51) Int. Cl.
*G03C 1/10* (2006.01)
*G03C 7/407* (2006.01)

(52) U.S. Cl. ..... 430/611; 430/567; 430/600; 430/603; 430/613; 430/363; 430/433

(58) Field of Classification Search ..... 430/567, 430/600, 603, 611, 613, 363, 433
See application file for complete search history.

(56) References Cited

U.S. PATENT DOCUMENTS

| | | | | |
|---|---|---|---|---|
| 1,275,701 | A | 8/1918 | Kingsbacher et al. | |
| 2,222,264 | A | 11/1940 | Nietz et al. | |
| 2,403,927 | A | 7/1946 | Kendall et al. | |
| 2,448,060 | A | 8/1948 | Smith et al. | |
| 2,566,245 | A | 8/1951 | Adrian et al. | |
| 2,566,263 | A | 8/1951 | Trivelli et al. | |
| 2,824,001 | A | 2/1958 | Allen et al. | |
| 3,266,897 | A | 8/1966 | Kennard et al. | |
| 3,320,069 | A | 5/1967 | Illingsworth | |
| 5,134,060 | A | 7/1992 | Maekawa et al. | |
| 6,689,552 | B1 * | 2/2004 | Ly et al. | 430/552 |
| 6,696,236 | B1 * | 2/2004 | Nakahira et al. | 430/567 |
| 2002/0076661 | A1 | 6/2002 | Kawamura et al. | |

FOREIGN PATENT DOCUMENTS

| | | | |
|---|---|---|---|
| JP | 9-146213 | A | 6/1997 |
| JP | 10-171080 | A | 6/1998 |
| JP | 2000-112051 | A | 4/2000 |
| JP | 2001-22018 | A | 4/2000 |
| JP | 2001-174944 | A | 6/2001 |
| JP | 2001-188311 | A | 7/2001 |
| JP | 2002-162707 | A | 6/2002 |
| JP | 2002-182326 | A | 6/2002 |

* cited by examiner

*Primary Examiner*—Hoa Van Le
(74) *Attorney, Agent, or Firm*—Frishauf, Holtz, Goodman & Chick, P.C.

(57) ABSTRACT

A silver halide photographic material, including a support having thereon a silver halide emulsion layer, the silver halide emulsion layer containing silver halide particles having a silver chloride content of more than or equal to 90 mol %, wherein a compound represented by Formula (S) is contained in the interior and on a surface of the silver halide particles and in a binder of the silver halide emulsion layer, and the silver halide particles have more than two silver halide phases therein having different concentration of the compound represented by Formula (S):

Formula (S)

15 Claims, No Drawings

SILVER HALIDE PHOTOSENSITIVE MATERIAL AND IMAGE FORMING METHOD THEREFOR

This application is a U.S. National Phase Application under 35 USC 371 of International Application PCT/JP2002/012113, filed Nov. 20, 2002.

TECHNICAL FIELD

The present invention relates to a silver halide photographic material and a method for forming an image using the same, whereby a color print is obtained by exposure and photographic processing based on digital information, and particularly relates to a silver halide photographic material of high sensitivity, excellent gradation, good storage stability and pressure resistance, exhibiting superiority in reproduction of text and colors, and a method for forming an image using the same.

BACKGROUND ART

In recent years, opportunities of treating images as digital data have rapidly increased along with enhancement of computing power, and progress in networking technology. Image information obtained by a digital camera or image information which has been digitized from photographic film or prints using a scanner can be readily edited, or supplemented with text or illustrations on a computer. Examples of hard copy material used to prepare a hard copy based on such digitized image information include a sublimation type thermal print, melt type thermal print, ink-jet print, electrostatic transfer type print, thermoautochrome print and silver halide color photographic material. Of these, silver halide photographic material (hereinafter, also referred to as photographic material) has greatly superior characteristics such as high sensitivity, superior tone, superior image lasting quality and lower cost, compared to other print material and therefore, is broadly employed for preparation of high quality hard copy prints.

Digitized image information can be readily edited on a computer, leading to increased opportunities of manipulating images comprised of a mixture of images based on captured data of people, landscapes, still-life (hereinafter, also denoted as scenic images) and characters (specifically, thin small black text). Accordingly, natural reproduction of scenic images and character reproduction without blurring are simultaneously required in image output based on digital data.

Recently, various digital exposure devices to conduct exposure based on digitalized image information, have become commercially available. Further, a number of new digital image exposure devices have been developed along with the progress in exposure light sources and control devices. Of these digital image exposure devices, devices employing a light source exhibiting a sharp light source wavelength distribution, such as laser or LED are becoming the main trend. Although the spread of various digital image exposure devices has launched a variety of imaging devices on the market, the kind of lasers and LED installed therein has not been uniform, and exposure devices are usually different in exposure wavelength. Further, in many cases, there are differences in various terms such as overlap ratio of exposure beams, exposure time interval between adjacent pixels, and exposure time and intensity per pixel, even when employing the same exposure light source. Therefore, when employing different exposure devices, quality of the reproduced prints fluctuates, resulting specifically in color bleeding at the edges of text characters, and improvement of quality in such fluctuation has been sought.

Further, according to the kinds of digital exposure devices, since it is difficult to stably control the amount of light at the low end of the exposure scale, in some cases, print density in highlighted areas fluctuates even when using the same digital data, and it is also desired to minimize these fluctuations. These problems may be minimized by optimization of photographic material with respect to each exposure device or each exposure condition, however, the variety of exposure devices on the market is large, and continues to increase. Therefore, the standardization of photographic material is not a realistic approach. Under these circumstance, desired is a silver halide photographic material which can provide an excellent print exhibiting sharp character edges with less bleeding, and superiority in color reproduction, employing any exposure device and under any printing condition, and a method for forming an image using the same.

Recently, on the other hand, mini-lab shops, so called "One Hour Photo", featuring a short time processing (being within 45–60 min.), are becoming common. For this reason, use of color paper having a high silver chloride content and exhibiting superior photographic processing characteristics has become widespread. Color paper having such high silver chloride content tends not to exhibit high sensitivity under above digital exposure, compared to usual analog exposure, and further, exhibits problems in gradation, fogging, storage stability before exposure, and pressure resistance to scratching, as an example. Thus, various improving technologies have been disclosed (please refer, for example, to Patent Documents 1–3), however, sufficient effects are not obtained in actual practice. Specifically, problems are in sensitivity, gradation (by extension, color reproduction), and storage stability, and thus, early solutions are desired.

An object of the present invention is to provide a silver halide photographic material and a method for forming an image using the same, whereby a color print is obtained by exposure and photographic processing based on digital information, and particularly to provide a silver halide photographic material having high sensitivity, excellent gradation, storage stability and pressure resistance while exhibiting superiority in reproduction of text and colors, and a method for forming an image using the same.

Patent Document 1: Unexamined Japanese patent Application Publication (hereinafter, referred to as JP-A) 2002-182326

Patent Document 2: JP-A 2002-162707

Patent Document 3: JP-A 2001-188311

DISCLOSURE OF INVENTION

The above object of the present invention can be achieved by the following embodiments.

(1) A silver halide photographic material, comprising a support having thereon a silver halide emulsion layer, the silver halide emulsion layer containing a binder and silver halide particles having a silver chloride content of more than or equal to 90 mol %, wherein a compound represented by Formula (S) is contained in an interior portion and on a surface of the silver halide particles and in a binder of the silver halide emulsion layer:

Formula (S)

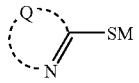

wherein Q is a 5- or 6-membered nitrogen containing heterocyclic ring, M is a hydrogen atom, an alkaline metal atom or a group being necessary to form a mono-valent cation.

(2) The silver halide photographic material of Item 1 above, wherein the silver halide particles have more than two silver halide phases therein differing concentration of the compound represented by Formula (S).

(3) The silver halide photographic material of Items 1 or 2 above, wherein in the interior of the silver halide particles, a silver halide phase, having lower concentration of the compound represented by Formula (S) than another silver halide phase having maximum concentration of the compound represented by Formula (S), is on the outside of the silver halide phase having maximum concentration of the compound represented by Formula (S).

(4) The silver halide photographic material of any one of Items 1 to 3 above, wherein the compound represented by Formula (S) is a compound represented by Formula (S-2):

Formula (S-2)

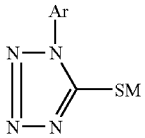

wherein Ar is a group represented by the following formulas;

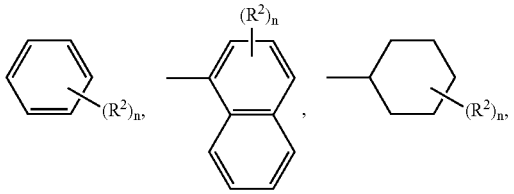

$R^2$ is an alkyl group, an alkoxy group, a carboxyl group or a salt thereof, a sulfo group or a salt thereof, a hydroxyl group, an amino group, an acylamino group, a carbamoyl group, or a sulfonamide group, n is an integer of 0 to 2, and M is the same as M in Formula (S).

(5) The silver halide photographic material of any one of Items 1 to 4 above, wherein a pH of a surface of the silver halide emulsion layer is 4 to 7.

(6) A method for forming an image, comprising the steps of:

exposing the silver halide photographic material of any one of Items 1 to 5 with a scanning exposure method; and conducting color developing process to the exposed photographic material.

The present invention is characterized by a silver halide photographic material, comprising a support having thereon a silver halide emulsion layer, the silver halide photosensitive layer containing silver halide particles having a silver chloride content of 90 or more mol %, wherein a compound represented by foregoing Formula (S) is contained in the interior and on the surface of the silver halide particles and in the binder of the silver halide emulsion layer.

Initially, a compound represented by Formula (S) will be described.

In Formula (S), examples of a 5-membered heterocyclic ring, represented by Q, include for example, an imidazole ring, a tetrazole ring, a thiazole ring, an oxazole ring, a selenazole ring, a benzoimidazole ring, a naphthoimidazole ring, a benzothiazole ring, a naphthothiazole ring, a benzoselenazole ring, a naphthoselenazole ring, and a benzoxazole ring, while examples of a 6-membered heterocyclic ring, represented by Q, include a pyridine ring, a pyrimidine ring, and a quinoline ring, and these 5- or 6-membered heterocyclic rings may include rings having a substituted group.

In Formula (S), examples of alkaline metal atoms represented by M include a sodium atom, and a potassium atom.

The mercapto compound represented by Formula (S) is preferably a compound represented by following Formulas (S-1), (S-2), (S-3) or (S-4).

Formula (S-1)

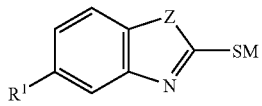

In Formula (S-1), $R^1$ is a hydrogen atom, a halogen atom, an alkyl group, an alkoxy group, an aryl group, a carboxyl group or a salt thereof, a sulfo group or a salt thereof, or an amino group, Z is —NH—, —O—, or —S—, while M is the same as M in Formula (S).

Formula (S-2)

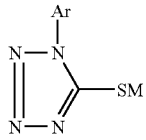

In Formula (S-2), Ar is a group represented by the following formulas;

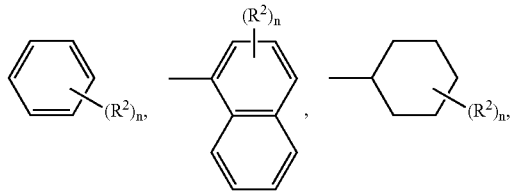

$R^2$ is an alkyl group, an alkoxy group, a carboxyl group or a salt thereof, a sulfo group or a salt thereof, a hydroxyl group, an amino group, an acyamino group, a carbamoyl group or a sulfonamide group, while n is an integer of 0–2, and M is the same as M in Formula (S).

In Formulas (S-1) and (S-2), an alkyl group represented by $R^1$ and $R^2$ includes, for example, a methyl group, an ethyl group and a butyl group, and an alkoxy group includes, for example, a methoxy group and an ethoxy group; a salt of a carboxyl group or a sulfo group, includes, for example, a sodium salt and an ammonium salt.

In Formula (S-1), an aryl group represented by $R^1$ includes, for example, a phenyl group, and a naphthyl group, while a halogen atom includes, for example, a chlorine atom, and a bromine atom.

In Formula (S-2), an acylamino group represented by $R^2$ includes, for example, a methylcarbonylamino group, and a benzoylamino group, a carbamoyl group includes, for example, an ethylcarbamoyl group, and a phenylcarbamoyl group, while an sulfonamide group includes, for example, a methylsufoamide group, and a phenylsulfoamide group.

The above alkyl group, alkoxy group, aryl group, amino group, acylamino group, carbamoyl group and sulfonamide group include a group having a further substituted group.

Formula (S-3)

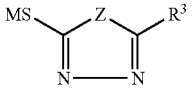

In Formula (S-3), Z is —$NR^3$—, an oxygen atom, or a sulfuric atom, $R^3$ is a hydrogen atom, an alkyl group, an aryl group, an alkenyl group, a cycloalkyl group, —$SR^{31}$, —$NR^{32}(R^{33})$—, —$NHCOR^{34}$, —$NHSO_2R^{35}$, or a heterorring group; $R^{31}$ is a hydrogen atom, an alkyl group, an alkenyl group, a cycloalkyl group, an aryl group, —$COR^{34}$ or —$SO_2R^{35}$; $R^{32}$ and $R^{33}$ each are a hydrogen atom, an alkyl group or an aryl group, $R^{34}$ and $R^{35}$ each are an alkyl group or an aryl group, while M is the same as M in Formula (S).

In Formula (S-3), an alkyl group represented by $R^3$, $R^{31}$, $R^{32}$, $R^{33}$, $R^{34}$ and $R^{35}$ includes, for example, a methyl group, an ethyl group and a propyl group, while an aryl group includes a phenyl group and a naphthyl group.

Further, an alkenyl group represented by $R^3$ and $R^{31}$ includes, for example, an propenyl group, while a cycloalkyl group includes, for example, a cyclohexyl group. Further, a hetero ring group represented by $R^3$ includes, for example, a furyl group and a pyridinyl group.

An alkyl group and an aryl group represented by above $R^3$, $R^{31}$, $R^{32}$, $R^{33}$, $R^{34}$ and $R^{35}$, an alkenyl group and a cycloalkyl group represented by $R^3$ and $R^{31}$, and a hetero ring group represented by $R^3$, include a group having a further substituted group.

Formula (S-4)

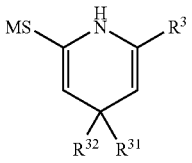

In Formula (S-4), $R^3$ and M each are the same groups as $R^3$ and M in Formula (S-3). Further, $R^{31}$ and $R^{32}$ each are the same groups as $R^{31}$ and $R^{32}$ in Formula (S-3).

Specific examples of compounds represented by Formula (S) are shown below, but the present invention is not limited to these examples.

S-1-1

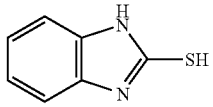

S-1-2

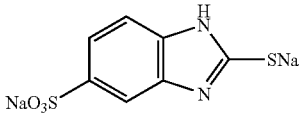

S-1-3

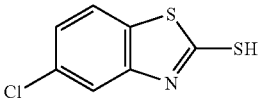

S-1-4

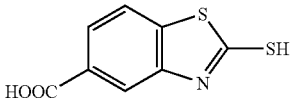

S-1-5

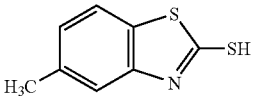

S-1-6

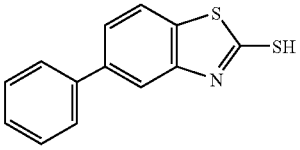

S-1-7

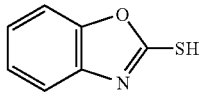

S-1-8

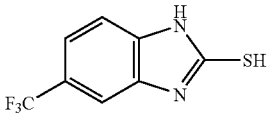

S-2-1

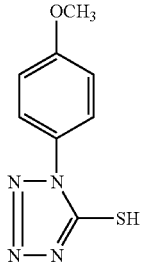

S-2-2

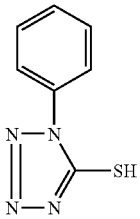

S-2-3

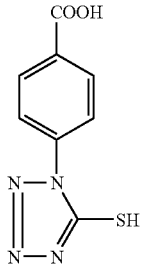

S-2-4

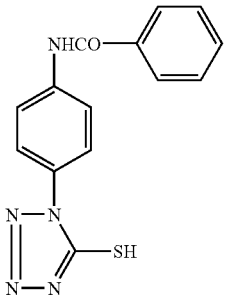

S-2-5

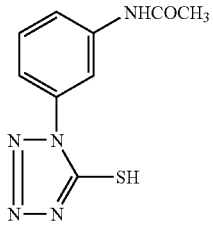

S-2-6

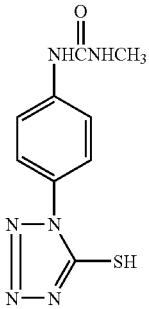

-continued

S-2-7

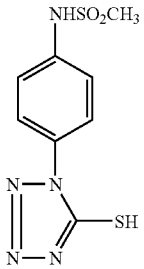

S-2-8

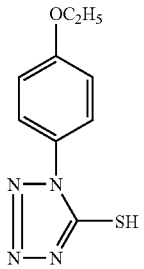

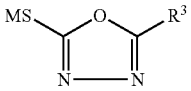

| Exemplified compound | $R^3$ | M |
|---|---|---|
| S-3-1 | $—C_2H_5$ | —H |
| S-3-2 | $—CH_2—CH=CH_2$ | —H |
| S-3-3 | $—CH_2=CH—CH_2—CH_3$ | —H |
| S-3-4 | $—C_7H_{15}$ | —H |
| S-3-5 | $—C_9H_{19}$ | —Na |
| S-3-6 | 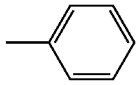 | —H |
| S-3-7 | $—C_4H_9(t)$ | —H |
| S-3-8 | 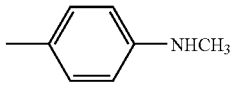 | —H |
| S-3-9 | 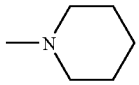 | —H |
| S-3-10 | 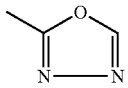 | —H |
| S-3-11 | 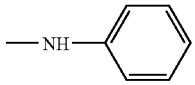 | —H |
| S-3-12 | 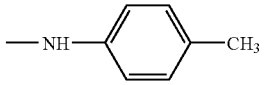 | —H |
| S-3-13 | $—NHCOCH_3$ | —H |
| S-3-14 | 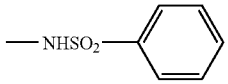 | —H |
| S-3-15 | $—N(CH_3)_2$ | —H |
| S-3-16 | 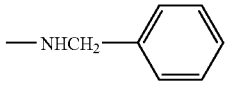 | —H |
| S-3-17 | 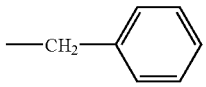 | —H |

-continued

| | | |
|---|---|---|
| S-3-18 | $—S—CH_3$ | —H |
| S-3-19 | 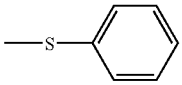 | —H |
| S-3-20 | —SH | —H |

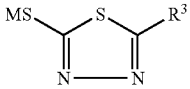

| Exemplified compound | $R^3$ | M |
|---|---|---|
| S-3-21 | —H | —H |
| S-3-22 | $—C_2H_5$ | —H |
| S-3-23 | $—C_4H_9(t)$ | —H |
| S-3-24 | $—C_6H_{13}$ | —H |
| S-3-25 | 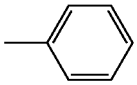 | —H |
| S-3-26 | 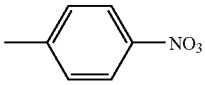 | —H |
| S-3-27 | 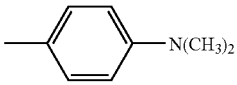 | —H |
| S-3-28 | 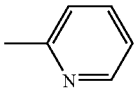 | —H |
| S-3-29 | 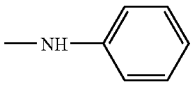 | —H |
| S-3-30 | $—NH_2—N(CH_3)_2$ | —H |
| S-3-31 | $—CH_2CH=CH_2$ | —H |
| S-3-32 | —SH | —H |
| S-3-33 | $—NHCOC_2H_5$ | —H |

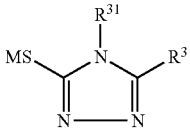

| Exemplified compound | $R^3$ | $R^{31}$ | M |
|---|---|---|---|
| S-3-34 | $—C_2H_5$ | —H | —H |
| S-3-35 | $—CH_3$ | $—CH_3$ | —H |
| S-3-36 | $—CH_3$ | 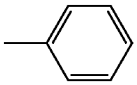 | —H |
| S-3-37 | $—NHCOCH_3$ | $—CH_3$ | —H |
| S-3-38 | 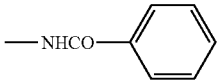 | 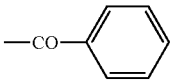 | —H |
| S-3-39 | $—NHCOCH_3$ | $—COCH_3$ | —H |

-continued

| | | | |
|---|---|---|---|
| S-3-40 | —NHCOCH$_3$ | —CH$_2$— | —H |
| S-3-41 | —NHCOC$_2$H$_5$ | —CN | Na |
| S-3-42 | —NHCO— | — | H |
| S-3-43 | —NHSO$_2$CH$_3$ | —H | H |
| S-3-44 | —NHCO— —OCH$_3$ | —CH$_3$ | Na |
| S-3-45 | —NHCO— | —CH$_2$CH=CH$_2$ | H |
| S-3-46 | —NHCO— | —CH$_2$CH$_2$O— | —H |

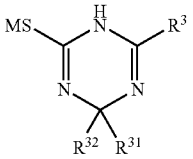

| Exemplified compound | R$^3$ | R$^{31}$ | R$^{32}$ | M |
|---|---|---|---|---|
| S-4-1 | —C$_2$H$_5$ | —CH$_3$ | —CH$_3$ | —H |
| S-4-2 | — | —CH$_3$ | —CH$_3$ | —H |
| S-4-3 | —NH$_2$ | —H | — | —H |
| S-4-4 | —NH— —Cl | —H | —C$_4$H$_9$ | —H |
| S-4-5 | —NHCOCH$_3$ | —CH$_3$ | —CH$_3$ | —H |
| S-4-6 | —NHCO— | —CH$_3$ | —CH$_3$ | —H |
| S-4-7 | —NH— | —CH$_3$ | —C$_3$H$_7$(i) | —H |

-continued

S-4-8

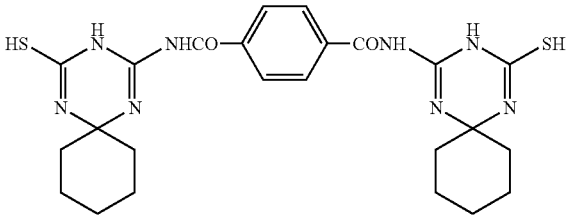

The compounds represented by foregoing Formula (S) include compounds described in, for example, Examined Japanese Patent Application Publication No. (hereinafter, referred to as JP-B) 40-28496, JP-A 50-89034, Journal of Chemical Society (J. Chem. Soc.) 49, 1748 (1927) and 4237 (1952), Journal of Organic Chemistry (J. Org, Chem.) 39, 2469 (1965), U.S. Pat. No. 2,824,001, J. Chem. Soc. 1723 (1951), JP-A 56-111846, and U.S. Pat. Nos. 1,275,701, 3,266,897, and 2,403,927. Further, the compounds can be synthesized with methods described in these documents.

In this invention, it is a specifically preferable embodiment to employ a compound represented by Formula (S-2), which tends to enhance the effects of this invention.

For the compound represented by Formula (S) of this invention [hereinafter, referred to as Compound (S)] to be included in the silver halide emulsion layer of this invention, Compound (S) may be dissolved in water or an organic solvent which can be freely mixed with water (such as methanol and ethanol), and then added. Compound (S) may be employed alone or in combination with other compounds represented by Formula (S), other stabilizing agents other than the compounds represented by Formula (S), or a fogging inhibitor.

The period of addition of Compound (S) is preferably at least once before the initiation of silver halide particle formation and prior to the end of silver halide particle formation, and at least once after the end of silver halide particle formation and at the end of chemical sensitization, and at least once after the end of chemical sensitization and prior to a coating operation, but is more preferably at least once during silver halide particle formation, and at least once after the end of silver halide particle formation and at the end of chemical sensitization, as well as after the end of chemical sensitization and a coating operation.

Compound (S) may be added all at once, in several equal steps, over time, or in several varied steps.

Specifically, in cases when Compound (S) is added into the interior of silver halide particles, it is preferable that Compound (S) is added so that more than two silver halide phases having different concentrations are formed, and it is more preferable that Compound (S) is added so that the maximum concentration phase is formed in the silver halide particle and subsequently the lower concentration phase are formed outside of that portion of the particle.

Further, due to diffusion at the time of multi-layer coating, compound (S) may be directly added into a coating composition of the silver halide emulsion, or may be included in a binder of the silver halide emulsion layer by addition into a coating composition of the adjacent non-light sensitive hydrophilic colloidal layer of this invention.

The added amount of Compound (S) is not specifically limited, but is usually added in the range of $1\times10^{-6}$–$1\times10^{-1}$ mol per mol of silver halide, but preferably $1\times10^{-5}$–$1\times10^{-2}$ mol.

The silver chloride particle of this invention necessarily requires to have a high silver chloride content of at least 90 mol % or more. In cases when the silver chloride content is less than 90 mol %, rapid processability is impaired, so that preferred is more than 95 mol %. The remaining content is preferably silver bromide, containing basically no silver iodide. The silver bromide content is preferably 0.03–3 mol %, and specifically preferably 0.05–2 mol %.

The silver halide particle of this invention may include silver bromide in various forms. That is, the silver halide particle may form a so-called solid dispersion in which silver bromide is uniformly distributed in the whole silver halide particle, or the phases containing the silver bromide may nonuniformly exist in the particle. In the case of nonuniformity, the phase containing silver bromide may take various forms. For example, the silver halide particle forms a so-called core-shell structure in which the phase having a different silver bromide content forms a core or a shell, or the phase containing more silver bromide may form a localized phase within areas or on portions of the surface of the particle. In this invention, from the viewpoint of achieving high sensitivity, silver bromochloride phases are localized on the particle surface.

Any shape of the silver halide particles according to the present invention may be employed as appropriately. Adding to a cube having so called (100) faces as crystal surfaces, particles in the shape of octahedron, tetradecahedron, or dodecahedron are prepared according to methods described in U.S. Pat. Nos. 4,183,756 and 4,225,966, JP-A 55-26589, JP-B 55-42737 and in the Journal of Photographic Science (J. Photogr. Sci.), Vol. 21, pg. 39 (1973), and are subsequently employed. Further, employed may be particles having twinning faces or tabular silver halide particles. In this invention, preferred are cubic silver halide particles exhibiting (100) surfaces as crystal surfaces which are superior in productivity and production stability.

As the silver halide particles of this invention, particles of the same shape are preferably employed. In addition, two or more monodispersed silver halide emulsions are preferably added to the same layer.

Silver halide particles employed in this invention are not limited with respect to particle diameter, but the particle diameter is preferably 0.1 to 5.0 μm, and more preferably 0.2 to 3.0 μm in terms of rapid processability, sensitivity and other desirable photographic characteristics. Specifically, in cases when such cubes are employed, the particle diameter is preferably 0.1–1.2 μm, but more preferably 0.2–1.0 μm. The particle diameter can be determined using particle projected areas or diameter approximation values. In the case of silver halide particles having basically uniform shape, the particle diameter distribution may be presented in terms of diameter or projection area.

With regard to particle diameter distribution, preferred is monodispersed silver halide particles having a coefficient of variation of 0.05–0.22, but more preferably 0.05–0.15. It is specifically preferred that at least two kinds of monodispersed particle emulsions having a coefficient of variation of 0.05–0.15 are included in the same layer. The coefficient of variation refers to a coefficient representing the width of the particle diameter distribution and defined based on the following equation:

$$\text{coefficient of variation} = S/R$$

wherein S is the standard deviation of particle diameter distribution and R is the mean particle diameter. Herein, the particle diameter is the diameter in the case of a spherical particle, and in the case of being cubic, or a shape other than spherical form, the particle diameter is a diameter of a circle having an area equivalent to the projected particle area.

Apparatuses for preparing the silver halide emulsion and the preparation methods known in the art in the photographic industry may be employed.

The silver halide emulsion can be prepared employing either an acid method, a neutral method or an ammonia method. The particles may be grown all at once during a single period or may be grown after preparing seed particles. The method for preparing seed particles and the method for growing particles may be the same or different.

Further, as methods for reacting soluble silver salts with soluble halide salts, any of the normal mixing methods, such as a reverse mixing method, a double jet method or a combination thereby may be employed. However, the particles obtained with the double jet method are preferred. Further, employed may be a pAg controlled double jet method which is described as one of the double jet methods in JP-A 54-48521.

Furthermore, apparatuses may be employed described in JP-A Nos. 57-92523 and 57-92524, wherein an aqueous water-soluble silver salt solution and an aqueous halide salt solution are supplied from addition devices arranged within a reaction mother solution, an apparatus described in German Patent Open to Public Inspection No. 2,921,164, wherein an aqueous water-soluble silver salt solution and an aqueous halide salt solution are added while continuously changing the concentration, an apparatus described in Japanese Translation of PCT International Application Publication No. 56-501776, wherein a reaction mother solution is removed from a reactor and by increasing the concentration using an ultrafiltration method, particles are grown while maintaining a constant distance between silver halide particles. Furthermore, silver halide dissolving solvents such as thioether may be employed, if appropriate.

In the silver halide particles of this invention, various multivalent metallic ions may be incorporated alone or in combination during the process of particle formation or during physical ripening. For example, listed are a salt of cadmium, zinc, copper, thallium, or gallium, or a salt or complex of the Group VIII Transition Metal ions such as ion, ruthenium, rhodium, palladium, osmium, iridium and platinum, however in the silver halide emulsion relating to the present invention, heavy metal ions are advantageously incorporated. The addition amount of these heavy metal ions covers a wide range for various purposes, but preferred is $1\times10^{-10}$–$1\times10^{-3}$ mol per mol of silver halide.

The silver halide particles of this invention are preferably subjected to chemical sensitization. As chemical sensitization methods, listed are a gold sensitization method employing a gold compound (for example, described in U.S. Pat. Nos. 2,448,060 and 3,320,069), a sensitization method employing a metal such as iridium, platinum or palladium (for example, described in U.S. Pat. Nos. 2,448,060, 2,566,245 and 2,566,263), a sulfur sensitization method employing a sulfur containing compound (for example, described in U.S. Pat. No. 2,222,264), and a combination of two or more methods above.

The silver halide particles of this invention are preferably subjected to sulfur sensitization, gold sensitization or a combination of both. Specific sulfur sensitizing agents include unstable sulfur compounds such as a thiosulfate (such as hypo), a thiourea (such as diphenylthiourea, triethylthiourea, or an allylthiourea), and rhodanines, and the added amount is typically about $10^{-7}$–$10^{-2}$ mol per mol of silver halide. As gold sensitizing agents, specifically listed are chloroaurate, chloroauric acid salt, thiocyanatoaurate, gold sulfide and gold selenate, the added amount is typically about $10^{-7}$–$10^{-2}$ mol per mol of silver halide.

The silver halide particles of this invention are subjected to spectral sensitization at desired wavelength regions by addition of a dye which absorbs light of the areas corresponding wavelength to the targeted spectral sensitivity (being a spectral sensitizing dye). Examples of the spectral sensitizing dyes employed in this invention include compounds, for example, described in F. M. Hamer, Heterocyclic Compounds—Cyanine Dye and Related Compounds, John Wiley and Sons, New York, 1964. The spectral sensitizing dyes of this invention include a cyanine dye, a merocyanine dye, and a complex merocyanine dye. Other than these, included are a complex cyanine dye, a holopolar cyanine dye, a hemicyanine dye, a styryl dye and a hemioxonol dye. AS a cyanine dye, a simple cyanine dye, a carbocyanine dye and a dicarbocyanine dye are preferably employed. The added spectral sensitizing dye may be added as a crystal or powder, however, is preferably added dissolved or dispersed in any appropriate way. To dissolve the spectral sensitizing dye, employed may be a water soluble solvent such as an alcohol featuring 1–3 carbon atoms, acetone, pyridine or methyl cellosolve, or mixtures of these solvents. Further, the dye may be employed after micelle dispersion using a surface active agent, or after dispersion with other dispersing methods.

The added amount of the dye of this invention covers a wide range in individual cases, however, the amount is typically $1\times10^{-6}$–$1\times10^{-2}$ mol per mol of silver halide, but preferably $1\times10^{-5}$–$1\times10^{-3}$ mol.

Employed in this invention are dyes having absorption at various wavelengths in the photographic material for anti-irradiation and anti-halation, and for enhancing safelight characteristics. For these purposes, it is preferable to add dyes decolorable with photographic processes (being an oxonol dye and a cyanine dye), the processes being described in European Patent EP 337490A2, pp. 27–76.

As a coupler employable in the silver halide photographic material of this invention, employed may be any compound capable of forming a coupling product having a spectral absorption maximum wavelength of wavelength regions longer than 340 nm by a coupling reaction with an oxide of a color developing agent. A specifically typical compound is known as a yellow coupler having a spectral absorption maximum wavelength in the wavelength region of 350–500 nm, a magenta coupler having a spectral absorption maximum wavelength in the wavelength region of 500–600 nm, and a cyan coupler having a spectral absorption maximum wavelength in the wavelength region of 600–750 nm.

Examples of cyan couplers preferably employed in the photographic material of this invention include couplers described in JP-A 4-114152, on page 17 of the specification, while represented by formulas (C-I) and (C-II). Specific compounds thereof include CC-1–CC-9 described in the foregoing specification on pp. 18–21.

Examples of magenta couplers preferably employed in the photographic material of this invention include couplers represented by formula (M-I) described in JP-A 4-114152 on page 12 of the specification. Examples of specific compounds thereof include MC-1–MC-7 described on pp. 13–16 in the foregoing specification.

Examples of yellow couplers preferably employed in the photographic material of this invention include couplers represented by formula (Y-I) described in JP-A 4-114152 on page 8 of the specification. Examples of specific compounds thereof include YC-1–YC-9 described on pp. 9–11 in the foregoing specification. Of these, preferred are YC-8 and YC-9 described on pg. 11 in the foregoing specification as these couplers can reproduce yellow of preferable tones.

When an oil-in-water type-emulsifying dispersion method is employed for addition of couplers in the silver halide photographic material of the present invention, in a water-insoluble high boiling organic solvent, having a boiling point of 150° C. or more, wherein the couplers may be dissolved using a low boiling and/or a water-soluble organic solvent, in combination if necessary. In a hydrophilic binder such as an aqueous gelatin solution, the above-mentioned solutions are emulsified and dispersed via a surface active agent. As a dispersing means, a stirrer, a homogenizer, a colloidal mill, a flow jet mixer or a supersonic dispersing device may be used. After dispersion or at the same time as dispersion, a process to remove the low boiling organic solvent may be conducted. Preferred examples of such high boiling solvents to dissolve and disperse the couplers include phthalic acid esters such as dioctyl phthalate, and phosphoric acid esters such as tricresyl phosphate.

Instead of the method employing the high boiling organic solvent, alternatively employed may be a method to dissolve the coupler and a water-insoluble and organic solvent-soluble polymeric compound, which may be dissolved in a low boiling and/or water-soluble organic solvent, and then dispersed in a hydrophilic binder such as an aqueous gelatin using a surface active agent employing various dispersing means. In this case, examples of the water-insoluble and organic solvent-soluble polymeric compound include poly (N-t-butylacrylamide).

Regarding other additives employable in the photographic material of this invention, none are specifically limited, and examples of the additives include compounds described, for example, in Research Disclosure Nos. 17643, 18716 and 308119 (hereinafter, abbreviated as RD17643, RD18716 and RD308119 respectively).

In the photographic material of this invention, advantageously employed as a binder is gelatin. Further, optionally employed may be other hydrophilic colloidal materials, such as gelatin derivatives, graft polymers of gelatin with other polymers, proteins other than gelatin, saccharide derivatives, cellulose derivatives and synthetic hydrophilic polymeric materials such as monomers or polymers.

In the photographic material of this invention, it is preferable to adjust pH of the surface of the material within the range of 4–7 using an appropriate acid or alkaline aqueous solution. In this invention, a hardening agent for the binder may be employed. A vinylsulfone type hardening agent or a chlorotriazine type hardening agent is preferably employed. As a vinylsulfone type hardening agent, preferably employed are compounds described from line 13 at the upper right of pg. 25 to line 2 at the upper right of pg. 27, in the specification of JP-A 61-249054. Further, more preferably is compound H-12 described on pg. 26 in the same specification. As a chlorotriazine type hardening agent, preferably employed are compounds described from the first line at the lower left of pg. 3 to line 4 from the bottom at the lower right of pg. 3, and from line 4 from the bottom at the lower right of pg. 3 to the lower left of pg. 5, in the specification of JP-A 61-245153. Further, more preferably is compound XII-1 described on pg. 4 of the same specification. These compounds are preferably employed in combinations and may be incorporated in any layer. The hardening agent is preferably incorporated in an amount of 0.1–10 weight % to the binder.

A variety of supports may be employed in the photographic material of this invention, including paper coated with polyethylene containing a white pigment, baryta paper, a polyvinyl chloride sheet, as well as a polypropylene or polyethylene terephthalate support containing a white pigment. Of these, preferred is a support having on the surface a polyolefin resin layer containing a white pigment.

A white pigment employable in a reflecting support of this invention includes inorganic or organic white pigments, and an inorganic white pigment is preferably employed. Examples thereof include alkaline earth metal sulfates such as barium sulfate, alkaline earth metal carbonates such as calcium carbonate, silica such as a fine powdery silicate or a synthetic silicate, calcium silicate, alumina, alumina hydrate, titanium oxide, zinc oxide, talc, and clay. The preferred white pigments include barium sulfate and titanium oxide.

The amount of the white pigment incorporated in the water-proof resin layer on the surface of the reflecting support of this invention is preferably not less than 10 weight %, more preferably not less than 13 weight %, and still more preferably not less than 15 weight %. The dispersion degree of a white pigment in the water-proof resin layer of the paper support of this invention can be measured employing the procedure described in JP-A 2-28640. In this case, the dispersion degree, which is represented by a coefficient of variation, is preferably not more than 0.20, more preferably not more than 0.15, and still more preferably not more than 0.10.

In the photographic material of this invention, the surface of the support may be optionally subjected to corona discharge, UV light exposure or flame treatment and further, coated component layers thereon may be, directly or through a subbing layer (i.e., one or more subbing layers for achieving improvement in surface properties of the support, such as adhesion property, antistatic property, dimensional stability, friction resistance, hardness, anti halation and/or other characteristics).

In coating of the photographic material using the silver halide emulsion, a viscosity increasing agent may be employed to enhance coatability of a coating composition. As a coating method, specifically useful are an extrusion coating method and a curtain coating method, in which two or more layers are simultaneously applied.

To form a photographic image using the silver halide photographic material of this invention, a recorded image on negative film may be printed by providing the image optically on the photographic material to be printed; or the image may first be converted to digital information and that information is provided on CRT (being a cathode ray tube) as the image, and then the image is printed on the photographic material; or the image may be printed by scanning with changing laser light intensity based on the digital information. Specifically preferred is the method which prints via scanning with changing laser light intensity.

The color developing agent employed in the color developing solution in this invention includes aminophenol or p-phenilenediamine derivatives which are widely used in various color photographic processes. Examples of these compounds include the following compounds.

CD-1: N,N-diethyl-p-phenylendiamine

CD-2: 2-amino-5-diethylaminotoluene

CD-3: 2-amino-5-(N-ethyl-N-laurylamino)toluene

CD-4: 4-amino-3-methyl-N-ethyl-N-(β-methanesulfoneamido)-ethyl)aniline

CD-5: 2-methyl-4-(N-ethyl-N-(β-hydroxyethyl)amino) aniline

CD-6: 4-amino-3-methyl-N-ethyl-N-[β-(methanesulfonamide)ethyl]-aniline

CD-7: N-(2-amino-5-diethylaminophenylethyl)-methane sulfonamide

CD-8: N,N-dimethyl-p-phenylenediamine

CD-9: 4-amino-3-methyl-N-ethyl-N-metoxyethylaniline

CD-10: 4-amino-3-methyl-N-ethyl-N-(β-ethoxyethyl) aniline

In addition to the developing agents described above, a developing solution may be incorporated with commonly known developing solution component compounds, including an alkaline agent exhibiting a pH-buffering action, a development inhibiting agent such as a chloride ion or benzotriazoles, a preservative agent, and a chelating agent.

The color developing temperature is usually 15° C. or more, and generally in the range of 20–50° C. For rapid processing, it is preferable to conduct the color developing process at 30° C. or higher. The color developing time is generally between five seconds and four minutes, however for rapid processing, it is preferable to do so in the range of 5–60 seconds, and if desired for more rapid processing, preferably it is in the range of 5–30 seconds. In cases when such rapid processing is conducted, the effects of this invention are more prominently exhibited.

In cases when the photographic material of this invention is subjected to running processing by continuously replenishing the color developing solution, the replenishing rate of the color developing solution is preferably 20–150 ml per $m^2$ of the photographic material, in order to minimize adverse environmental by the effluent. Further, it is preferable to control replenishment so as to generate minimal effluent overflow, and the targeted replenishing rate is 20–60 ml. In cases when such rapid processing under a low replenishing rate is conducted, the effects of this invention are more prominently exhibited.

The silver halide photographic material of this invention is subjected to a bleaching process and a fixing process after the color developing process. The bleaching process may be conducted at the same time as the fixing process. After the fixing process, usually a washing process is conducted. Further, instead of the washing process, a stabilizing process may be conducted. A photographic processing apparatus for processing the silver halide photographic material of this invention may be a roller transport type in which the photographic material is transported by pressing the material between rollers provided in the processing tanks, or an endless belt type in which the photographic material is transported by clipping it to the belt, however, employed may be a method in which processing tanks are formed as a slit and the photographic material is transported through the slit tank applying the processing solution to the slit processing tank, a spray method in which a processing solution is sprayed onto the surface of the photographic material, a web method in which the material contacts a carrier impregnated with a processing solution, or a method employing viscous processing solutions.

EXAMPLES

Next, the present invention will be specifically described with examples, but this invention is not limited to these examples.

Example 1

Silver halide emulsions were prepared based on the following methods.

Preparation of Blue Sensitive Silver Halide Emulsion (Preparation of Emulsions B-1–B-11)

To 1 liter of 2% gelatin aqueous solution maintained at 40° C., following (Solution A1) and (Solution B1) were added with a double jet method over 30 minutes, while controlling pAg at 7.3 and pH at 3.0. Subsequently, following (Solution A2) and (Solution B2) were added with a double jet method over 150 minutes, while controlling pAg at 8.0 and pH at 5.5. Further, following (Solution A3) and (Solution B3) were added with a double jet method over 30 minutes, controlling pAg at 8.0 and pH at 5.5. At this stage, control of the pAg was conducted based on the method described in JP-A 59-45437, and control of the pH was conducted using sulfuric acid or a sodium hydroxide aqueous solution.

| | |
|---|---|
| Solution A1 | |
| Sodium chloride | 3.42 g |
| Potassium bromide | 0.03 g |
| Water to make | 200 ml |
| Solution A2 | |
| Sodium chloride | 71.9 g |
| $K_2IrCl_6$ | $4 \times 10^{-8}$ mol/mol AgX |
| $K_4Fe(CN)_6$ | $2 \times 10^{-5}$ mol/mol AgX |
| Potassium bromide | 0.7 g |
| Water to make | 420 ml |
| Solution A3 | |
| Sodium chloride | 30.8 g |
| Potassium bromide | 0.3 g |
| Water to make | 180 ml |
| Solution B1 | |
| Silver nitrate | 10 g |
| Water to make | 200 ml |
| Solution B2 | |
| Silver nitrate | 210 g |
| Water to make | 420 ml |
| Solution B3 | |
| Silver nitrate | 90 g |
| Water to make | 180 ml |

After the addition, the resulting emulsion was desalted using a 5% aqueous solution of Demol N (produced by Kao Corp.) and a 20% magnesium sulfate aqueous solution, which was mixed in a gelatin aqueous solution to obtain Silver Halide Emulsion B-1 being a monodisperse cubic particle emulsion having an average particle size (being a converted particle size from cubic volume) of 0.64 μm, a coefficient of variation of particle size of 0.07, a silver chloride content of 99.5 mol % and a silver bromide content of 0.5 mol %.

In silver Halide Emulsion B-1, when referring to the particle growth portion with Solutions A1 and B1 being a seed portion, the particle growth portion with Solutions A2 and B2 being a core portion, and the particle growth portion with Solutions A3 and B3 being a shell portion, the volume ratio of each of the seed portion, the core portion and the shell portion in the silver halide particle was 3.3%, 66.7% and 30.0% respectively.

Silver Halide Emulsion B-2 was prepared in the same manner as above Silver Halide Emulsion B-1, except that Compound S-2-5 was added into Solutions A1, A2 and A3 in advance, in an amount of $2.1\times10^{-6}$ mol/mol AgX, $4.3\times10^{-5}$ mol/mol AgX and $1.9\times10^{-5}$ mol/mol AgX respectively to the finally obtained silver halide particle (hereinafter, referred to as AgX).

Further, Silver Halide Emulsions B-3–B-11 were prepared in the same manner as above Silver Halide Emulsion B-2, except that the kinds and the amounts of compounds added to Solutions A1, A2 and A3 were adequately adjusted or combined to become the compositions listed in the following table.

Composition of Seed Portion

| Emulsion No. | Volume of Seed Portion (vol %) | Compound (S) Kind | Content (mol/mol AgX) | Concentration (mol/mol AgX) |
|---|---|---|---|---|
| B-1 | 3.3 | none | 0 | 0 |
| B-2 | 3.3 | S-2-5 | $2.1 \times 10^{-6}$ | $6.4 \times 10^{-5}$ |
| B-3 | 3.3 | S-2-5 | $4.2 \times 10^{-6}$ | $1.3 \times 10^{-4}$ |
| B-4 | 3.3 | S-2-5 | $6.0 \times 10^{-7}$ | $1.8 \times 10^{-5}$ |
| B-5 | 3.3 | S-2-5 | $2.1 \times 10^{-6}$ | $6.4 \times 10^{-5}$ |
| B-6 | 3.3 | S-2-5 | $4.2 \times 10^{-6}$ | $1.3 \times 10^{-4}$ |
| B-7 | 3.3 | S-2-3 | $2.1 \times 10^{-6}$ | $6.4 \times 10^{-5}$ |
| B-8 | 3.3 | S-1-4 | $2.1 \times 10^{-6}$ | $6.4 \times 10^{-5}$ |
| B-9 | 3.3 | S-3-6 | $2.1 \times 10^{-6}$ | $6.4 \times\times 10^{-5}$ |
| B-10 | 3.3 | S-4-4 | $2.1 \times 10^{-6}$ | $6.4 \times 10^{-6}$ |
| B-11 | 3.3 | none | 0 | 0 |

Composition of Core Portion

| Emulsion No. | Volume of Seed Portion (vol %) | Compound (S) Kind | Content (mol/mol AgX) | Concentration (mol/mol AgX) |
|---|---|---|---|---|
| B-1 | 66.7 | none | 0 | 0 |
| B-2 | 66.7 | S-2-5 | $4.3 \times 10^{-5}$ | $6.4 \times 10^{-5}$ |
| B-3 | 66.7 | S-2-5 | $8.6 \times 10^{-5}$ | $1.3 \times 10^{-4}$ |
| B-4 | 66.7 | S-2-5 | $1.2 \times 10^{-5}$ | $1.8 \times 10^{-5}$ |
| B-5 | 66.7 | S-2-5 | $5.3 \times 10^{-5}$ | $7.9 \times 10^{-5}$ |
| B-6 | 66.7 | S-2-5 | $1.1 \times 10^{-4}$ | $1.6 \times 10^{-4}$ |
| B-7 | 66.7 | S-2-3 | $5.3 \times 10^{-5}$ | $7.9 \times 10^{-5}$ |
| B-8 | 66.7 | S-1-4 | $5.3 \times 10^{-5}$ | $7.9 \times 10^{-5}$ |
| B-9 | 66.7 | S-3-6 | $5.3 \times 10^{-5}$ | $7.9 \times 10^{-5}$ |
| B-10 | 66.7 | S-4-4 | $5.3 \times 10^{-5}$ | $7.9 \times 10^{-5}$ |
| B-11 | 66.7 | S-2-5 | $5.3 \times 10^{-5}$ | $7.9 \times 10^{-5}$ |

Composition of Shell Portion

| Emulsion No. | Volume of Core Portion (vol %) | Compound (S) Kind | Content (mol/mol AgX) | Concentration (mol/mol AgX) |
|---|---|---|---|---|
| B-1 | 30 | none | 0 | 0 |
| B-2 | 30 | S-2-5 | $1.9 \times 10^{-5}$ | $6.3 \times 10^{-5}$ |
| B-3 | 30 | S-2-5 | $3.8 \times 10^{-5}$ | $1.3 \times 10^{-4}$ |
| B-4 | 30 | S-2-5 | $5.4 \times 10^{-5}$ | $1.8 \times 10^{-5}$ |
| B-5 | 30 | S-2-5 | $9.0 \times 10^{-6}$ | $3.0 \times 10^{-5}$ |
| B-6 | 30 | S-2-5 | $1.5 \times 10^{-5}$ | $5.0 \times 10^{-4}$ |
| B-7 | 30 | S-2-3 | $9.0 \times 10^{-6}$ | $3.0 \times 10^{-5}$ |
| B-8 | 30 | S-1-4 | $9.0 \times 10^{-6}$ | $3.0 \times 10^{-5}$ |
| B-9 | 30 | S-3-6 | $9.0 \times 10^{-6}$ | $3.0 \times 10^{-5}$ |
| B-10 | 30 | S-4-4 | $9.0 \times 10^{-6}$ | $3.0 \times 10^{-5}$ |
| B-11 | 30 | S-2-5 | $9.0 \times 10^{-6}$ | $3.0 \times 10^{-5}$ |

The content of Compound (S) is the content to the total amount of the finally formed silver halide.

Concentration of Compound (S) is the silver halide amount in each of, the seed portion, the core portion and the shell portion.

Preparation of Blue Sensitive Silver Halide Emulsion B-1A–B-11A

Subsequently, above Silver Halide Emulsion B-1 was subjected to ripening at 65° C., 7.3 pAg and 5.6 pH following addition of the following compounds, and after adequate spectral sensitization and chemical sensitization, $5\times10^{-4}$ mol/mol AgX of Compound (S-2-2) was added and cooled, to obtain Blue Sensitive silver Halide Emulsion B-1A.

| | |
|---|---|
| 1. Sodium thiosulfate | $5 \times 10^{-6}$ mol/mol AgX |
| 2. Chloroauric acid | $1.5 \times 10^{-5}$ mol/mol AgX |
| 3. Compound (S-2-5) | $3 \times 10^{-4}$ mol/mol AgX |
| 4. Sensitizing dye (BS-1) | $4 \times 10^{-4}$ mol/mol AgX |
| 5. Sensitizing dye (BS-2) | $1 \times 10^{-4}$ mol/mol AgX |

Next, Blue Sensitive Silver Halide Emulsions B-2A–B-11A were prepared in the same manner as in the preparation of above Blue Sensitive Silver Halide Emulsion B-1A, except that Silver Halide Emulsion B-1 was sequentially replaced by Silver Halide Emulsions B-2–B-11 and each emulsion was subjected to optimal spectral sensitization and chemical sensitization.

Preparation of Blue Sensitive Silver Halide Emulsion B-11B

Blue Sensitive Silver Halide Emulsion B-11B was obtained in the same manner as above Blue Sensitive Silver Halide Emulsion B-11A, except that $5\times10^{-4}$ mol/mol AgX of Compound (S-1-4) was added instead of Compound (S-2-2), and $5\times10^{-4}$ mol/mol AgX of Compound (S-4-4) instead of Compound (S-2-5).

Preparation of Blue Sensitive Silver Halide Emulsion B-11C

Blue Sensitive Silver Halide Emulsion B-11C was obtained in the same manner as above Blue Sensitive Silver Halide Emulsion B-11A, except that the added amount of each of Compounds (S-2-2) and (S-2-5) was changed to $7\times10^{-4}$ mol/mol AgX and $6\times10^{-4}$ mol/mol AgX respectively.

Preparation of Green Sensitive Silver Halide Emulsion

Preparation of Emulsions G-1–G-11

Silver Halide Emulsion G-1 as a monodisperse cubic particle emulsion having an average particle size (being a converted particle size from cubic volume) of 0.50 μm, a coefficient of variation of particle size of 0.08, a silver chloride content of 99.5 mol % and a silver bromide content of 0.5 mol %, was produced in the same manner as foregoing Silver Halide Emulsion B-1, except that addition time of (Solution A1), (Solution B1), (Solution A2), (Solution B2), (Solution A3) and (Solution B3) was appropriately changed.

Further, Silver Halide Emulsions G-2–G-11 were prepared in the same manner as preparation of foregoing Silver Halide Emulsions B-2–B-11, except that the amounts or kinds of compounds added into (Solution A1), (Solution A2) and (Solution A3) were appropriately adjusted or combined to become compositions similar to the above emulsions described in the tables.

Preparation of Green Sensitive Silver Halide Emulsions G-1A–G-11A

Above Silver Halide Emulsions G-1–G-11 were subjected to ripening at 65° C., 7.1 pAg and 5.0 pH with addition of the following compounds, and after appropriate spectral sensitization and chemical sensitization, $8\times10^{-4}$ mol/mol AgX of Compound (S-2-2) was added and cooled, to result in Green Sensitive Silver Halide Emulsions G-1A–G11A.

| | |
|---|---|
| 1. Sensitizing dye (GS-1) | $4 \times 10^{-4}$ mol/mol AgX |
| 2. Chloroauric acid | $1.5 \times 10^{-5}$ mol/mol AgX |
| 3. Compound (S-2-5) | $1.2 \times 10^{-4}$ mol/mol AgX |
| 4. Sodium thiosulfate | $4.5 \times 10^{-6}$ mol/mol AgX |

Preparation of Green Sensitive Silver Halide Emulsion G-11B

Green Sensitive Silver Halide Emulsion G-11B was produced in the same manner as above Silver Halide Emulsion G-11A, except that added was $8\times10^{-4}$ mol/mol AgX of Compound (S-1-4) instead of Compound (S-2-2), and $1.2\times10^{-4}$ mol/mol AgX of Compound (S-4-4) instead of Compound (S-2-5).

Preparation of Green Sensitive Silver Halide Emulsion G-11C

Green Sensitive Silver Halide Emulsion G-11C was produced in the same manner as above Silver Halide Emulsion G-11A, except that the added amount of each of Compounds (S-2-2) and (S-2-5) was changed to $1.2\times10^{-3}$ mol/mol AgX and $3.2\times10^{-4}$ mol/mol AgX respectively.

Preparation of Red Sensitive Silver Halide Emulsion

Preparation of Emulsions R-1–R-11

Silver Halide Emulsion R-1 as a monodisperse cubic particle emulsion of an average particle size (being a converted particle size from cubic volume) of 0.40 μm, a coefficient of variation of particle size of 0.08, a silver chloride content of 99.5 mol % and a silver bromide content of 0.5 mol %, was produced in the same manner as foregoing Silver Halide Emulsion B-1, except that addition time of (Solution A1), (Solution B1), (Solution A2), (Solution B2), (Solution A3) and (Solution B3) each was appropriately changed.

Further, Silver Halide Emulsions R-2–R-11 were prepared in the same manner as preparation of foregoing Silver Halide Emulsions B-2–B-11, except that the amounts or kinds of compounds added into (Solution A1), (Solution A2) and (Solution A3) each were appropriately adjusted or combined to become compositions similar to the above emulsions described in above tables.

Preparation of Red Sensitive Silver Halide Emulsions R-1A–R-11A

Above Silver Halide Emulsions R-1–R-11 were subjected to ripening at 65° C., 7.1 pAg and 5.0 pH following addition of the following compounds, and after optimal spectral sensitization and chemical sensitization, $8\times10^{-4}$ mol/mol AgX of Compound (S-2-2) was added and cooled, to obtain Red Sensitive Silver Halide Emulsions R-1A–R11A.

| | |
|---|---|
| 1. Sodium thiosulfate | $1.2 \times 10^{-5}$ mol/mol AgX |
| 2. Chloroauric acid | $1.5 \times 10^{-5}$ mol/mol AgX |
| 3. Compound (S-2-5) | $1.2 \times 10^{-4}$ mol/mol AgX |
| 4. Sensitizing dye (RS-1) | $1 \times 10^{-4}$ mol/mol AgX |
| 5. Sensitizing dye (RS-2) | $1 \times 10^{-4}$ mol/mol AgX |

Preparation of Red Sensitive Silver Halide Emulsion R-11B

Red Sensitive Silver Halide Emulsion R-11B was produced in the same manner as above Silver Halide Emulsion R-11A, except that $8\times10^{-4}$ mol/mol AgX of Compound (S-1-4) instead of Compound (S-2-2) was added, and $1.2\times10^{-4}$ mol/mol AgX of Compound (S-4-4) instead of Compound (S-2-5).

Preparation of Red Sensitive Silver Halide Emulsion R-11C

Red Sensitive Silver Halide Emulsion R-11C was obtained in the same manner as above Silver Halide Emulsion R-11A, except that the added amount of each of Compounds (S-2-2) and (S-2-5) was chanted to $1.2\times10^{-3}$ mol/mol AgX and $3.2\times10^{-4}$ mol/mol AgX respectively.

Further, in the preparation of the red sensitive silver halide emulsions, $2.0\times10^{-3}$ mol/mol AgX of SS-1 was added.

Chemical formulas

BS-1

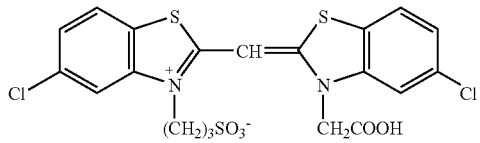

BS-2

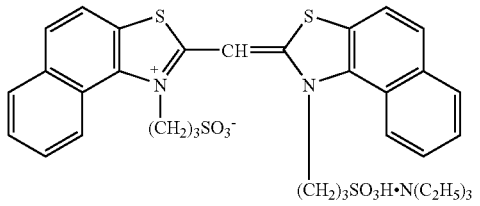

GS-1

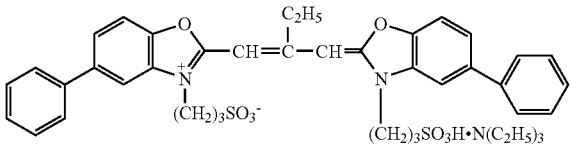

RS-1

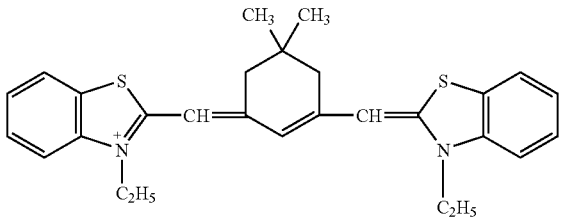

RS-2

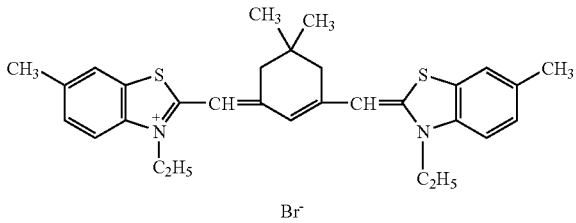

SS-1

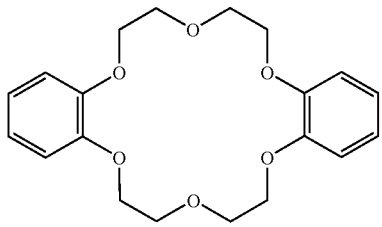

Preparation of Silver Halide Photographic Material

Preparation of Sample 101

The emulsion layer side of 180 g/m$^2$ weight paper was laminated with high density molten polyethylene containing surface-treated anatase type titanium oxide in an amount of 15 weight %, and the opposite side was laminated with simple high density polyethylene. This reflection support was subjected to corona discharge and provided with a gelatin subbing layer, and further thereon, the following component layers, as shown below, were provided to prepare silver halide photographic material Sample 101.

(First Layer Coating Composition)

Added to 60 ml of ethyl acetate were 3.34 g of Yellow Coupler (Y-1), 10.02 g of Yellow Coupler (Y-2), 1.67 g of Yellow Coupler (Y-3), 1.67 g of Dye Image Stabilizing Agent (ST-1), 1.67 g of Dye Image Stabilizing Agent (ST-2), 3.34 g of Dye Image Stabilizing Agent (ST-5), 0.167 g of Antistaining Agent (HQ-1), 2.67 g of Image Stabilizing Agent A, 5.0 g of High Boiling Organic Solvent (DBP), and 1.67 g of High Boiling Organic Solvent (DNP), and dissolved. The solution was dispersed into 320 ml of a 7% gelatin solution containing 5 ml of 10% Surface Active Agent (SU-1) employing an ultrasonic homogenizer to prepare 500 ml of a yellow coupler dispersion solution. The coupler solution was mixed with Blue Sensitive Silver Halide Emulsion (B-1A) prepared under the conditions below, to obtain the First Layer Coating Composition.

Second Layer Coating Composition—the Seventh Layer Coating Composition

Each of the Second Layer to the Seventh Layer Coating Composition was prepared in the same manner as the First Layer Coating Composition above so as to obtain the following coating coverage.

In addition, Hardening Agents (H-1) and (H-2) were incorporated into the Second, Fourth and Seventh Layers. Also incorporated were Surface Active Agents (SU-2) and (SU-3) which adjusted surface tension. Mildewcide (F-1) was further incorporated in an amount of 0.04 mg/m$^2$. The amount of the following silver halide contained in the respective layers was represented by an equivalent converted to silver.

| | g/m$^2$ |
|---|---|
| The Seventh Layer (Protective Layer) | |
| Gelatin | 0.70 |
| DBP | 0.002 |
| DIDP | 0.002 |
| Silicon dioxide | 0.003 |
| Sixth Layer (UV Absorbing Layer) | |
| Gelatin | 0.40 |
| AI-1 | 0.01 |
| UV absorbing Agent (UV-1) | 0.07 |
| UV absorbing Agent (UV-2) | 0.12 |
| Antistaining Agent (HQ-5) | 0.02 |
| Fifth Layer (Red Sensitive Layer) | |
| Gelatin | 1.00 |
| Red Sensitive Silver Chlorobromide Emulsion (Em-R1A) | 0.17 |
| Cyan Coupler (C-1) | 0.22 |
| Cyan Coupler (C-2) | 0.06 |
| Dye Image Stabilizing Agent (ST-1) | 0.06 |
| Antistaining Agent (HQ-1) | 0.003 |
| DBP | 0.10 |
| DOP | 0.20 |

-continued

| | g/m$^2$ |
|---|---|
| Fourth Layer (UV Absorbing Layer) | |
| Gelatin | 0.94 |
| AI-1 | 0.02 |
| UV Absorbing Agent (UV-1) | 0.17 |
| UV Absorbing Agent (UV-2) | 0.27 |
| Antistaining Agent (HQ-5) | 0.06 |
| Third Layer (Green Sensitive Layer) | |
| Gelatin | 1.30 |
| AI-2 | 0.01 |
| Green Sensitive Silver Chlorobromide Emulsion (Em-G1A) | 0.12 |
| Magenta Coupler (M-1) | 0.05 |
| Magenta Coupler (M-2) | 0.15 |
| Dye Image Stabilizing Agent (ST-3) | 0.10 |
| Dye Image Stabilizing Agent (ST-4) | 0.02 |
| DIDP | 0.10 |
| DBP | 0.10 |
| Second Layer (Interlayer) | |
| Gelatin | 1.20 |
| AI-3 | 0.01 |
| Antistaining Agent (HQ-1) | 0.02 |
| Antistaining Agent (HQ-2) | 0.03 |
| Antistaining Agent (HQ-3) | 0.06 |
| Antistaining Agent (HQ-4) | 0.03 |
| Antistaining Agent (HQ-5) | 0.03 |
| DIDP | 0.04 |
| DBP | 0.02 |
| First Layer (Blue Sensitive Layer) | |
| Gelatin | 1.10 |
| Blue Sensitive Silver Chlorobromide Emulsion (Em-B1A) | 0.24 |
| Yellow Coupler (Y-1) | 0.10 |
| Yellow Coupler (Y-2) | 0.30 |

-continued

| | g/m$^2$ |
|---|---|
| Yellow Coupler (Y-3) | 0.05 |
| Dye Image Stabilizing Agent (ST-1) | 0.05 |
| Dye Image Stabilizing Agent (ST-2) | 0.05 |
| Dye Image Stabilizing Agent (ST-5) | 0.10 |
| Antistaining Agent (HQ-1) | 0.005 |
| Image Stabilizing Agent A | 0.08 |
| Image Stabilizing Agent B | 0.04 |
| DNP | 0.05 |
| DBP | 0.15 |

Support: Polyethylene-laminated paper containing a small amount of colorant

Additives used in the preparation of Sample 101 were as follows:

SU-1: Sodium tri-i-propylnaphthalenesulfonate

SU-2: Di(2-ethylhexyl) sulfosuccinate.sodium salt

SU-3: (2,2,3,3,4,4,5,5-octafluoropentyl) sulfosuccinate-.sodium salt

DBP: Dibutyl phthalate

DNP: Dinonyl phthalate

DOP: Dioctyl phthalate

DIDP: Di-i-decyl phthalate

H-1: Tetrakis(vinylsulfonylmethyl)methane

H-2: 2,4-dichloro-6-hydroxy-s-triazine.sodium salt

HQ-1: 2,5-di-t-octylhydroquinone

HQ-2: 2,5-di-sec-dodecylhydroquinone

HQ-3: 2,5-di-sec-tetradecylhydroquinone

HQ-4: 2-sec-dodecyl-5-sec-tetradecylhydoquinone

HQ-5: 2,5-di(1,1-dimethyl-4-hexyloxycarbonyl)-butylhydroqinone

Image Stabilizing Agent A: p-t-octylphenol

Image Stabilizing Agent B: Poly(t-butylacrylamide)

Y-1

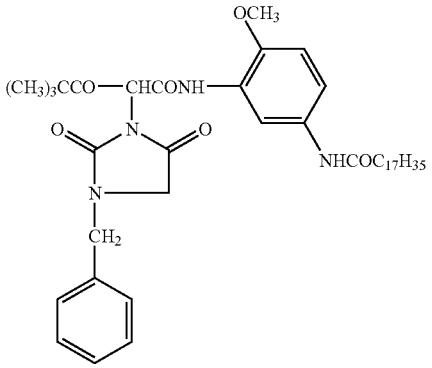

Y-2

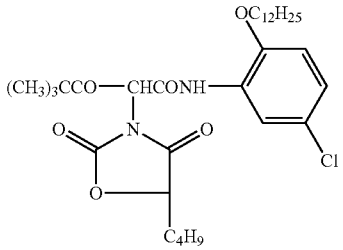

Y-3

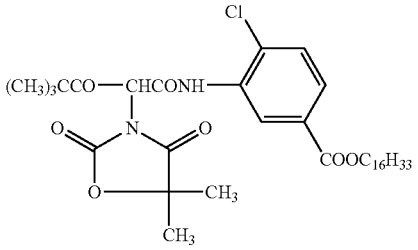

M-1

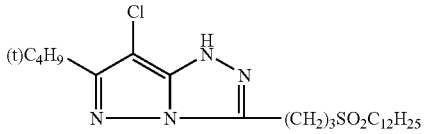

-continued
M-2
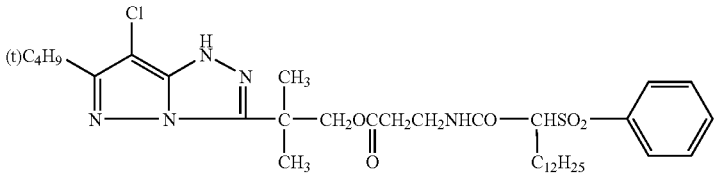
C-1
C-2
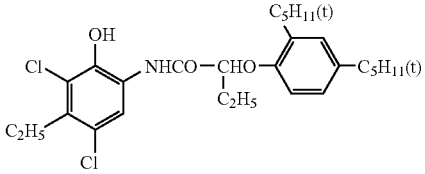
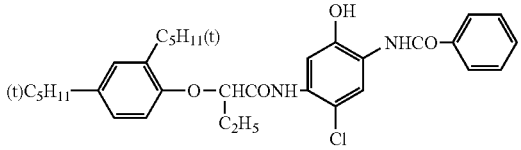
ST-1
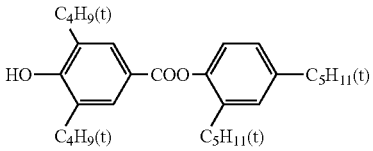
ST-2
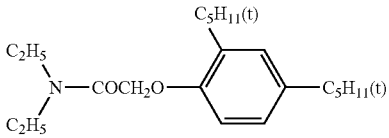
ST-3
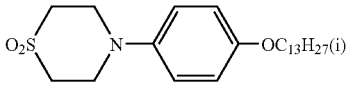
ST-4
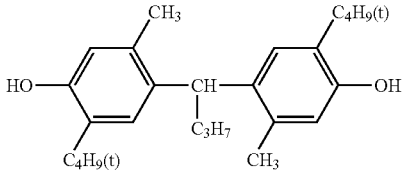
ST-5
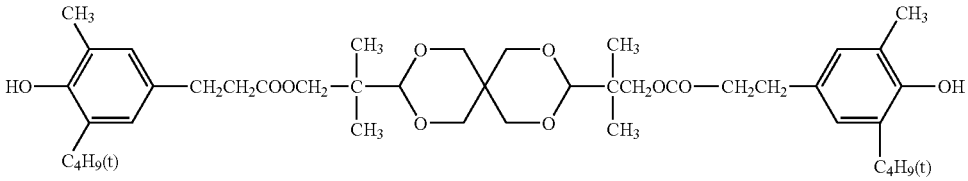
AI-1
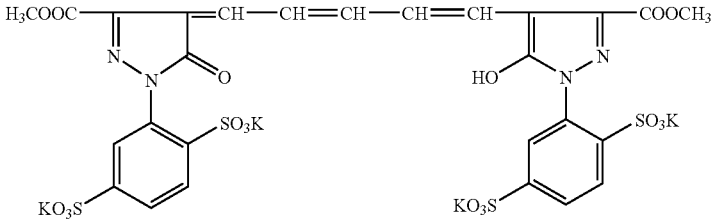
AI-2
AI-3
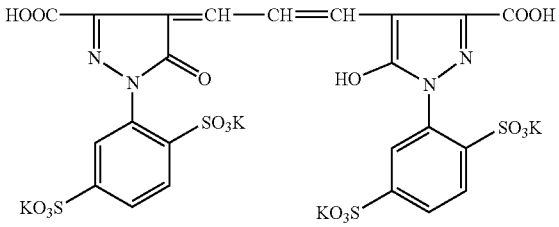
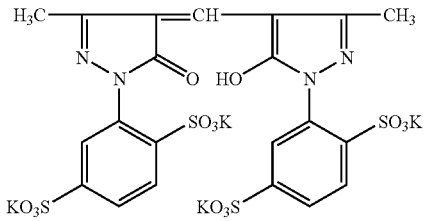
F-1
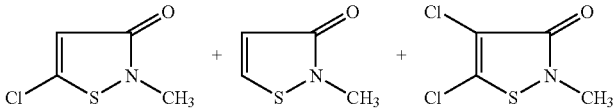
(50%) (46%) (4%) mol ratio
Mixture (mol ratio of 50:46:4)

-continued

UV-1

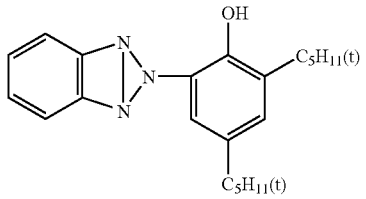

UV-2

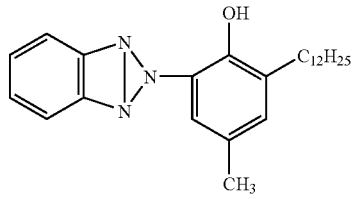

Preparation of Samples 102 and 103

Samples 102 and 103 were prepared in the same manner as Sample 101 above, except that Blue Sensitive Silver Halide Emulsion B-1A was changed to B-2A and B-3A respectively, Green Sensitive Silver Halide Emulsion G-1A was changed to G-2A and C-3A respectively, and Red Sensitive Silver Halide Emulsion was changed to R-2A and R-3A respectively.

Preparation of Sample 104

Sample 104 was prepared in the same manner as above Sample 101, except that the amounts of Compound (S-2-5) in the coating compositions of First Layer, Third Layer and Fifth Layer each were changed to $5\times10^{-4}$ mol/mol AgX, $6\times10^{-4}$ mol/mol AgX and $8\times10^{-4}$ mol/mol AgX respectively.

Preparation of Samples 105–115

Samples 105–115 were prepared in the same manner as Sample 104 above, except that Blue Sensitive Silver Halide Emulsion B-1A was sequentially changed to B-2A–B-11A and B-11B, Green Sensitive Silver Halide Emulsion G-1A was sequentially changed to G-2A–G-11A and G-11B, and Red Sensitive Silver Halide Emulsion R-1A was sequentially changed to R-2A–R-11A and R-11B.

Preparation of Sample 116

Sample 116 was prepared in the same manner as above Sample 114, except that in the coating compositions of First Layer, Third Layer and Fifth Layer Compound (S-2-5) was replaced with Compound (S-1-4), and the added amount of each was $5\times10^{-4}$ mol/mol AgX, $6\times10^{-4}$ mol/mol AgX and $8\times10^{-4}$ mol/mol AgX respectively.

Preparation of Sample 117

Sample 117 was prepared in the same manner as above Sample 114, except that in the coating compositions of First Layer, Third Layer and Fifth Layer Compound (S-2-5) was replaced with Compound (S-3-6), and the added amounts were each $5\times10^{-4}$ mol/mol Agx, $6\times10^{-4}$ mol/mol AgX and $8\times10^{-4}$ mol/mol AgX respectively.

Preparation of Sample 118

Sample 118 was prepared in the same manner as above Sample 114, except that in the coating compositions of First Layer, Third Layer and Fifth Layer Compound (S-2-5) was replaced with Compound (S-4-4), and the added amounts were each $5\times10^{-4}$ mol/mol AgX, $6\times10^{-4}$ mol/mol AgX and $8\times10^{-4}$ mol/mol AgX respectively.

In addition, in the preparation of the above Samples, coating was conducted after the film surface pH was adjusted to the values described in the following Table.

Preparation of Samples 119 and 120

Samples 119 and 120 were prepared in the same manner as Sample 114 above, except that coating was conducted after the pH of each layer coating composition was adjusted so that the film surface pH became as each value described in the following Table.

Preparation of Sample 121

Sample 121 was prepared in the same manner as Sample 101 above, except that Blue Sensitive Silver Halide Emulsion B-1A was changed to B-11C, Green Sensitive Silver Halide Emulsion G-1A to G-11C, and Red Sensitive Silver Halide Emulsion R-1A to R-11C, and also in the coating compositions of First Layer, Third Layer and Fifth Layer Compound (S-2-5) was added in the amount of $9\times10^{-4}$ mol/mol AgX, $9\times10^{-4}$ mol/mol AgX and $1.1\times10^{-3}$ mol/mol AgX respectively, and further, coating was conducted after the pH of each layer coating composition was adjusted so that the film surface pH equalled the value described in the following Table.

The compositions of prepared Samples 101–121 are shown in the following Tables.

| | AgX employed in each spectral sensitive layer | | | Film | |
|---|---|---|---|---|---|
| Sample No. | First layer | Second layer | Third layer | surface pH | Remarks |
| 101 | B-1A | G-1A | R-1A | 5.8 | Comp. |
| 102 | B-2A | G-2A | R-2A | 5.8 | Comp. |
| 103 | B-3A | G-3A | R-3A | 5.8 | Comp. |
| 104 | B-1A | G-1A | R-1A | 5.8 | Comp. |
| 105 | B-2A | G-2A | R-2A | 5.8 | Inv. |
| 106 | B-3A | G-3A | R-3A | 5.8 | Inv. |
| 107 | B-4A | G-4A | R-4A | 5.8 | Inv. |
| 108 | B-5A | G-5A | R-5A | 5.8 | Inv. |
| 109 | B-6A | G-6A | R-6A | 5.8 | Inv. |
| 110 | B-7A | G-7A | R-7A | 5.8 | Inv. |
| 111 | B-8A | G-8A | R-8A | 5.8 | Inv. |
| 112 | B-9A | G-9A | R-9A | 5.8 | Inv. |
| 113 | B-10A | G-10A | R-10A | 5.8 | Inv. |
| 114 | B-11A | G-11A | R-11A | 5.8 | Inv. |
| 115 | B-11B | G-11B | R-11B | 5.8 | Inv. |
| 116 | B-11A | G-11A | R-11A | 5.8 | Inv. |
| 117 | B-11A | G-11A | R-11A | 5.8 | Inv. |
| 118 | B-11A | G-11A | R-11A | 5.8 | Inv. |
| 119 | B-11A | G-11A | R-11A | 6.3 | Inv. |
| 120 | B-11A | G-11A | R-11A | 7.2 | Inv. |
| 121 | B-11C | G-11C | R-11C | 5.3 | Inv. |

note:
Comp.: Comparative example
Inv.: This invention

| Sample No. | Compound (S) adsorbed on AgX surface in First Layer Kind | Content (mol/mol AgX) | Compound (S) adsorbed on AgX surface in Third Layer Kind | Content (mol/mol AgX) | Remarks |
|---|---|---|---|---|---|
| 101 | S-2-2 | $5 \times 10^{-4}$ | S-2-2 | $8 \times 10^{-4}$ | Comp. |
| | S-2-5 | $3 \times 10^{-4}$ | S-2-5 | $1.2 \times 10^{-4}$ | |
| 102 | S-2-2 | $5 \times 10^{-4}$ | S-2-2 | $8 \times 10^{-4}$ | Comp. |
| | S-2-5 | $3 \times 10^{-4}$ | S-2-5 | $1.2 \times 10^{-4}$ | |
| 103 | S-2-2 | $5 \times 10^{-4}$ | S-2-2 | $8 \times 10^{-4}$ | Comp. |
| | S-2-5 | $3 \times 10^{-4}$ | S-2-5 | $1.2 \times 10^{-4}$ | |
| 104 | S-2-2 | $5 \times 10^{-4}$ | S-2-2 | $8 \times 10^{-4}$ | Comp. |
| | S-2-5 | $3 \times 10^{-4}$ | S-2-5 | $1.2 \times 10^{-4}$ | |
| 105 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 106 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 107 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 108 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 109 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 110 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 111 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 112 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 113 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 114 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 115 | S-1-4 | $5 \times 10^{-4}$ | S-1-4 | $8 \times 10^{-4}$ | Inv. |
| | S-4-4 | $5 \times 10^{-4}$ | S-4-4 | $1.2 \times 10^{-4}$ | |
| 116 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 117 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 118 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 119 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 120 | S-2-2 | $5 \times 10^{-4}$ | S-2-2 | $8 \times 10^{-4}$ | Inv. |
| | S-2-5 | $3 \times 10^{-4}$ | S-2-5 | $1.2 \times 10^{-4}$ | |
| 121 | S-2-2 | $7 \times 10^{-4}$ | S-2-2 | $1.2 \times 10^{-3}$ | Inv. |
| | S-2-5 | $6 \times 10^{-4}$ | S-2-5 | $3.2 \times 10^{-4}$ | |

| Sample No. | Compound (S) adsorbed on AgX surface in Fifth Layer Kind | Content (mol/mol AgX) | Compound (S) contained in binder at First Layer coating Kind | Content (mol/mol AgX) | Remarks |
|---|---|---|---|---|---|
| 101 | S-2-2 | $8 \times 10^{-4}$ | none | 0 | Comp. |
| | S-2-5 | $1.2 \times 10^{-4}$ | | | |
| 102 | S-2-2 | $8 \times 10^{-4}$ | none | 0 | Comp. |
| | S-2-5 | $1.2 \times 10^{-4}$ | | | |
| 103 | S-2-2 | $8 \times 10^{-4}$ | none | 0 | Comp. |
| | S-2-5 | $1.2 \times 10^{-4}$ | | | |
| 104 | S-2-2 | $8 \times 10^{-4}$ | S-2-5 | $5 \times 10^{-4}$ | Comp. |
| | S-2-5 | $1.2 \times 10^{-4}$ | | | |
| 105 | S-2-2 | $8 \times 10^{-4}$ | S-2-5 | $5 \times 10^{-4}$ | Inv. |
| | S-2-5 | $1.2 \times 10^{-4}$ | | | |
| 106 | S-2-2 | $8 \times 10^{-4}$ | S-2-5 | $5 \times 10^{-4}$ | Inv. |
| | S-2-5 | $1.2 \times 10^{-4}$ | | | |

-continued

| Sample No. | Compound (S) adsorbed on AgX surface in Fifth Layer Kind | Content (mol/mol AgX) | Compound (S) contained in binder at First Layer coating Kind | Content (mol/mol AgX) | Remarks |
|---|---|---|---|---|---|
| 107 | S-2-2 | $8 \times 10^{-4}$ | S-2-5 | $5 \times 10^{-4}$ | Inv. |
| | S-2-5 | $1.2 \times 10^{-4}$ | | | |
| 108 | S-2-2 | $8 \times 10^{-4}$ | S-2-5 | $5 \times 10^{-4}$ | Inv. |
| | S-2-5 | $1.2 \times 10^{-4}$ | | | |
| 109 | S-2-2 | $8 \times 10^{-4}$ | S-2-5 | $5 \times 10^{-4}$ | Inv. |
| | S-2-5 | $1.2 \times 10^{-4}$ | | | |
| 110 | S-2-2 | $8 \times 10^{-4}$ | S-2-5 | $5 \times 10^{-4}$ | Inv. |
| | S-2-5 | $1.2 \times 10^{-4}$ | | | |
| 111 | S-2-2 | $8 \times 10^{-4}$ | S-2-5 | $5 \times 10^{-4}$ | Inv. |
| | S-2-5 | $1.2 \times 10^{-4}$ | | | |
| 112 | S-2-2 | $8 \times 10^{-4}$ | S-2-5 | $5 \times 10^{-4}$ | Inv. |
| | S-2-5 | $1.2 \times 10^{-4}$ | | | |
| 113 | S-2-2 | $8 \times 10^{-4}$ | S-2-5 | $5 \times 10^{-4}$ | Inv. |
| | S-2-5 | $1.2 \times 10^{-4}$ | | | |
| 114 | S-2-2 | $5 \times 10^{-4}$ | S-2-2 | $5 \times 10^{-4}$ | Inv. |
| | S-2-5 | $1.2 \times 10^{-4}$ | | | |
| 115 | S-1-4 | $8 \times 10^{-4}$ | S-2-5 | $5 \times 10^{-4}$ | Inv. |
| | S-4-4 | $1.2 \times 10^{-4}$ | | | |
| 116 | S-2-2 | $8 \times 10^{-4}$ | S-1-4 | $5 \times 10^{-4}$ | Inv. |
| | S-2-5 | $1.2 \times 10^{-4}$ | | | |
| 117 | S-2-2 | $8 \times 10^{-4}$ | S-3-6 | $5 \times 10^{-4}$ | Inv. |
| | S-2-5 | $1.2 \times 10^{-4}$ | | | |
| 118 | S-2-2 | $8 \times 10^{-4}$ | S-4-4 | $5 \times 10^{-4}$ | Inv. |
| | S-2-5 | $1.2 \times 10^{-4}$ | | | |
| 119 | S-2-2 | $8 \times 10^{-4}$ | S-2-5 | $5 \times 10^{-4}$ | Inv. |
| | S-2-5 | $1.2 \times 10^{-4}$ | | | |
| 120 | S-2-2 | $8 \times 10^{-4}$ | S-2-5 | $5 \times 10^{-4}$ | Inv. |
| | S-2-5 | $1.2 \times 10^{-4}$ | | | |
| 121 | S-2-2 | $1.2 \times 10^{-4}$ | S-2-5 | $9 \times 10^{-4}$ | Inv. |
| | S-2-5 | $3.2 \times 10^{-4}$ | | | |

| Sample No. | Compound (S) contained in binder at Third Layer coating Kind | Content (mol/mol AgX) | Compound (S) contained in binder at Fifth Layer coating Kind | Content (mol/mol AgX) | Remarks |
|---|---|---|---|---|---|
| 101 | none | 0 | none | 0 | Comp. |
| 102 | none | 0 | none | 0 | Comp. |
| 103 | none | 0 | none | 0 | Comp. |
| 104 | S-2-5 | $6 \times 10^{-4}$ | S-2-5 | $8 \times 10^{-4}$ | Comp. |
| 105 | S-2-5 | $6 \times 10^{-4}$ | S-2-5 | $8 \times 10^{-4}$ | Inv. |
| 106 | S-2-5 | $6 \times 10^{-4}$ | S-2-5 | $8 \times 10^{-4}$ | Inv. |
| 107 | S-2-5 | $6 \times 10^{-4}$ | S-2-5 | $8 \times 10^{-4}$ | Inv. |
| 108 | S-2-5 | $6 \times 10^{-4}$ | S-2-5 | $8 \times 10^{-4}$ | Inv. |
| 109 | S-2-5 | $6 \times 10^{-4}$ | S-2-5 | $8 \times 10^{-4}$ | Inv. |
| 110 | S-2-5 | $6 \times 10^{-4}$ | S-2-5 | $8 \times 10^{-4}$ | Inv. |
| 111 | S-2-5 | $6 \times 10^{-4}$ | S-2-5 | $8 \times 10^{-4}$ | Inv. |
| 112 | S-2-5 | $6 \times 10^{-4}$ | S-2-5 | $8 \times 10^{-4}$ | Inv. |
| 113 | S-2-5 | $6 \times 10^{-4}$ | S-2-5 | $8 \times 10^{-4}$ | Inv. |
| 114 | S-2-5 | $6 \times 10^{-4}$ | S-2-5 | $8 \times 10^{-4}$ | Inv. |
| 115 | S-2-5 | $6 \times 10^{-4}$ | S-2-5 | $8 \times 10^{-4}$ | Inv. |
| 116 | S-1-4 | $6 \times 10^{-4}$ | S-1-4 | $8 \times 10^{-4}$ | Inv. |
| 117 | S-3-6 | $6 \times 10^{-4}$ | S-3-6 | $8 \times 10^{-4}$ | Inv. |
| 118 | S-4-4 | $6 \times 10^{-4}$ | S-4-4 | $8 \times 10^{-4}$ | Inv. |
| 119 | S-2-5 | $6 \times 10^{-4}$ | S-2-5 | $8 \times 10^{-4}$ | Inv. |
| 120 | S-2-5 | $6 \times 10^{-4}$ | S-2-5 | $8 \times 10^{-4}$ | Inv. |
| 121 | S-2-5 | $9 \times 10^{-4}$ | S-2-5 | $1.1 \times 10$ | Inv. |

Evaluation of Silver Halide Photographic Material

Samples 101–121 prepared as above were evaluated regarding sensitivity, fogging, gradation (γ), storage stability and pressure resistance based on the following methods.

Evaluation 1: Evaluation of Sensitivity and Fogging at High-intensity Exposure

Each of the samples was wedge exposed at $10^{-6}$ seconds employing a xenon flash sensitometer for high-intensity exposure (model SX-20, manufactured by Yamashita Denso Corp.), and after a 5 min. wait, the sample was subjected to a color photographic processing of the following steps. Reflection density of a yellow image after processing was measured employing an optical densitometer (model PDA-65, manufactured by Konica Corp.), and a characteristic curve of the yellow image was produced, reflection density (D) being on the vertical axis, and the exposure amount on the horizontal axis. The characteristic values were determined as follows.

Sensitivity of the samples was determined based on the following Formula 1. Sensitivity is expressed by a relative value, making sensitivity of Sample 101 to be 100. Further, fog density is the minimum density value in each characteristic curve, and expressed as a relative value, making sensitivity of Sample 101 to be 100.

Evaluation 2: Evaluation of Gradation (γ)

Next, gradation (γ) was determined based on the following Formula 2, and is expressed by a relative value, making sensitivity of Sample 101 to be 100.

$$\text{Sensitivity} = 1/(\text{exposure amount showing density of fogging} + 1.0) \quad \text{Formula 1}$$

$$\text{gradation}(\gamma) = 1/[\text{Log}(\text{exposure amount showing density of fogging} + 0.8) - \text{Log}(\text{exposure amount showing density of fogging} + 1.8)] \quad \text{Formula 2}$$

Evaluation 3: Storage Stability

Each of the samples was stored under the conditions of 55° C. and 40% RH for 6 days, and was subjected to photographic processing the same as for above Evaluation 1. Fog density of each sample was evaluated as a relative value, making fog density of Sample 101 immediately after photographic processing to be 100.

Evaluation 4: Evaluation of Pressure Resistance of the Photographic Material

Each of the samples was wedge exposed with blue light through a blue filter at $10^{-6}$ seconds employing a xenon flash sensitometer for high-intensity exposure (model SX-20, manufactured by Yamashita Denso Corp.). Each of the samples after exposure was soaked in 38° C. pure water for 45 seconds, and pressure was applied to the sample based on the following method, after which the sample was subjected to the photographic processing based on the following steps.

Pressure Application Method

The sample was fixed on a horizontal platform, and pressure was applied to the sample with a loaded needle conveyed at uniform speed in the direction perpendicular to the steps of the wedge. In this case, the needle was a sapphire stylus having a contact area of 0.3 mm diameter with the sample, and a scanning rate of the needle was 1 cm/sec., the load was sequentially changed to 10–100 g.

Each of the samples processed as above was visually observed, and pressure resistance of the sample was evaluated from the viewpoint of correlation between density changes in an un-exposed area and an exposed area and the pressure load. Evaluation of mastery of the samples was in 5 grades of A–E, and the sample showing no density change with pressure application was graded as A, while the sample showing density changes with low load and the lowest pressure resistance was graded as E, and then the difference between A and E was equally divided to determining pressure resistance values B–D.

Photographic Processing

| Step | Processing Temperature | Time | Replenishing Rate |
|---|---|---|---|
| Color Developing | 38.0 ± 0.3° C. | 45 sec. | 80 ml |
| Bleach Fixing | 35.0 ± 0.5° C. | 45 sec. | 120 ml |
| Stabilizing | 30–34° C. | 60 sec. | 150 ml |
| Drying | 60–80° C. | 30 sec. | |

Composition of Processing Solution

Color Developing: Tank Solution and Replenishing Solution

| | Tank Solution | Replenishing Solution |
|---|---|---|
| Pure Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.0 g |
| N,N-diethylhydroxylamine | 5.6 g | 6.0 g |
| Triethanolamine | 10.0 g | 10.0 g |
| Diethylenetriaminepentaacetate sodium salt | 2.0 g | 2.0 g |
| Fluorescent brightening agent (4,4'-diaminostilbene. disulfonic acid derivative) | 2.0 g | 2.5 g |
| Potassium carbonate | 30 g | 30 g |

Each of the total volume was brought to one liter by addition of water, and the pH of the tank solution was adjusted to 10.10 and the pH of the replenishing solution was adjusted to 10.60.

Bleach Fixing: Tank and Replenishing Solution

| | |
|---|---|
| Diethylenetriaminepentaacetate.Fe(II)ammonium dihydrate | 65 g |
| Diethylenetriaminepentaacetic acid | 3 g |
| Ammonium thiosulfate (a 70% aqueous solution) | 100 ml |
| 2-Amino-5-mercapto-1,3,4-thiadiazole | 2.0 g |
| Ammonium sulfite (a 40% aqueous solution) | 27.5 ml |

The total volume was brought to one liter by addition of water, and the pH was adjusted to 5.0 with potassium carbonate or glacial acetic acid.

Stabilizing: Tank and Replenishing Solution

| | |
|---|---|
| o-Phenylphenol | 1.0 g |
| 5-Chloro-2-methyl-4-isothiazoline-3-one | 0.02 g |

-continued

| Stabilizing: Tank and Replenishing Solution | |
|---|---|
| 2-Methyl-4-isothiazoline-3-one | 0.02 g |
| Diethylene glycol | 1.0 g |
| Fluorescent brightening agent (Chinopal SFP) | 2.0 g |
| 1-Hydroxyethylidene-1,1-diphosphonic acid | 1.8 g |
| Bismuth chloride (a 45% aqueous solution) | 0.65 g |
| Magnesium sulfate heptahydrate | 0.2 g |
| PVP (Polyvinyl pyrrolidone) | 1.0 g |
| Ammonia water (a 25% aqueous solution of ammonium hydrate) | 2.5 g |
| Trisodium nitrilotriacetate | 1.5 g |

The total volume was brought to one liter, and the pH was adjusted to 7.5 with sulfuric acid or ammonia water.

Each of the results obtained by the evaluation above is listed in the following table.

| Sample No. | Sen-sitivity | Fogging | Gradation (γ) | Storage stability | Pressure resistance | Remarks |
|---|---|---|---|---|---|---|
| 101 | 100 | 100 | 100 | 145 | E | Comp. |
| 102 | 110 | 93 | 115 | 137 | D | Comp. |
| 103 | 108 | 92 | 114 | 132 | D | Comp. |
| 104 | 110 | 95 | 119 | 135 | E | Comp. |
| 105 | 117 | 86 | 125 | 116 | C | Inv. |
| 106 | 118 | 87 | 126 | 114 | C | Inv. |
| 107 | 121 | 84 | 129 | 108 | B | Inv. |
| 108 | 140 | 71 | 139 | 86 | A | Inv. |
| 109 | 142 | 70 | 137 | 83 | A | Inv. |
| 110 | 141 | 70 | 138 | 86 | A | Inv. |
| 111 | 136 | 74 | 130 | 90 | B | Inv. |
| 112 | 135 | 73 | 131 | 87 | B | Inv. |
| 113 | 137 | 73 | 133 | 88 | A | Inv. |
| 114 | 143 | 70 | 133 | 83 | A | Inv. |
| 115 | 134 | 74 | 131 | 88 | B | Inv. |
| 116 | 135 | 75 | 130 | 89 | B | Inv. |
| 117 | 133 | 73 | 133 | 87 | A | Inv. |
| 118 | 136 | 73 | 130 | 86 | B | Inv. |
| 119 | 129 | 77 | 128 | 96 | B | Inv. |
| 120 | 128 | 82 | 126 | 106 | C | Inv. |
| 121 | 147 | 70 | 141 | 81 | A | Inv. |

As is apparent from the above table, it was proven that each sample employing the silver halide emulsions of this invention exhibited higher sensitivity and higher γ at high-intensity exposure, compared to the comparative samples, and provided excellent results in storage stability and pressure resistance. Further, the green sensitive layers and the red sensitive layers were evaluated similarly, and each sample employing the silver halide emulsions of this invention exhibited excellent characteristics, identical to the blue sensitive layer.

Example 2

The samples prepared in Example 1 were structured to be 127 mm width rolls, and digital exposure capability of the samples was evaluated with the following methods.

The color developed negative images of Konicacolor New Centuria 400 were converted to digital data employing Film Scanner Qscan 1202JW, manufactured by Konica Corp., so as to enable handling with Photoshop software (Ver. 5.5), produced by Adobe Systems Inc. To the captured images, various sizes of texts and thin lines were added to obtain single image data which could be exposed with the following digital scanning exposure apparatus.

As a light source, employed were 473 nm light extracted from a YAG solid laser (having an emission wavelength of 946 nm) with wavelength conversion using an SHG crystal of $KnbO_3$, using semiconductor laser CaAlAs (having an emission wavelength of 808.5 nm) as an exitation light source; 532 nm light extracted from a $YVO^4$ solid laser (having an emission wavelength of 1,064 nm) with wavelength conversion using an SHG crystal of KTP, using semiconductor laser GaAlAs (having an emission wavelength of 808.7 nm) as an exitation light source; and AlGaInP (having an emission wavelength of 670 nm). Prepared was an apparatus capable of sequentially conducting scanning-exposure on color photographic paper by transferring each of the three color lasers vertically to the scanning direction using a polygon mirror. The exposure amount was controlled by electrically changing the light intensity of the semiconductor lasers. Scanning exposure was conducted at 400 dpi (here, dpi is the dot numbers per inch, that is 2.54 cm), and at this time, exposure time per pixel was $5\times10^{-8}$ seconds.

In each of the samples, the exposure amount was adjusted to result in an optimal printed image, after scanning exposure, the photographic processing of Example 1 was changed to the following processing, and the printed image of a cabinet size (being 120×165 cm) was obtained.

The photographic processing of Example 1 was changed as follows.

| Step | Processing Temperature | Time | Replenishing Rate |
|---|---|---|---|
| Color Developing | 38.0 ± 0.3° C. | 22 sec. | 81 ml |
| Bleach Fixing | 35.0 ± 0.5° C. | 22 sec. | 54 ml |
| Stabilizing | 30–34° C. | 25 sec. | 150 ml |
| Drying | 60–80° C. | 30 sec. | |

Compositions of Processing Solutions are described below.

| Color Developing: Tank Solution and Replenishing Solution | Tank Solution | Replenishing Solution |
|---|---|---|
| Pure Water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.5 g |
| N,N-diethylhydroxylamine | 3.5 g | 6.0 g |
| N,n-bis(2-sulfoethyl)hydroxylamine | 3.5 g | 6.0 g |
| Triethanolamine | 10.0 g | 10.0 g |
| Diethylenetriaminepentaacetate sodium salt | 2.0 g | 2.0 g |
| Fluorescent brightening agent (4,4'-diaminostilbene·disulfonic acid derivative) | 2.0 g | 2.5 g |
| Potassium carbonate | 30 g | 30 g |

The total volume of each was brought to 1 liter by addition of water, and the pH of the tank solution was adjusted to 10.10 while the pH of the replenishing solution was adjusted to 10.60.

| Bleach Fixing: Tank Solution and Replenishing Solution | | |
|---|---|---|
| | Tank Solution | Replenishing Solution |
| Diethylenetriaminepentaacetate.Fe(II) ammonium dihydrate | 100 g | 50 g |
| Diethylenetriaminepentaacetic acid | 3 g | 3 g |
| Ammonium thiosulfate (a 70% aqueous solution) | 200 ml | 100 ml |
| 2-Amino-5-mercapto-1,3,4-thiadiazole | 2.0 g | 1.0 g |
| Ammonium sulfite (a 40% aqueous solution) | 50 ml | 25 ml |

The total volume was brought to 1 liter by addition of water, and the pH of Tank Solution was adjusted to 7.0 with potassium carbonate or glacial acetic acid, while the pH of Replenishing Solution was adjusted to 6.5.

| Stabilizing: Tank and Replenishing Solution | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Fluorescent brightening agent (Chinopal SFP) | 2.0 g |
| 1-Hydroxyethylidene-1,1-diphosphonic acid | 1.8 g |
| PVP | 1.0 g |
| Ammonia water (a 25% aqueous solution of ammonium hydrate) | 2.5 g |
| Ethylenediaminetetraacetic acid | 1.0 g |
| Ammonium sulfite (a 40% aqueous solution) | 10 ml |

The total volume was brought to 1 liter, and the pH was adjusted to 7.5 with sulfuric acid or ammonia water.

The obtained printed images were visually evaluated by 20 observers with respect to clarity of thin lines and text, reproduced flesh color and reproduced green of trees under the following criteria. Further, after 100 images were exposed, print reproducibility of the first and the 100th print was visually evaluated under the following criteria.

(1) Evaluation Criteria of Clarity of Thin Lines and Text
- A: Thin gray lines and text were easily distinguished.
- B: Thin gray lines and text were clearly distinguished, but with slightly blurred edges.
- C: Thin gray lines and text were distinguishable, but blurring was obvious.
- D: Thin gray lines and text were blurred, and in some distinguishing was difficult.

(2) Flesh Color Reproducibility
- A: Bright and natural reproduction was obtained.
- B: Natural reproduction was obtained.
- C: Slightly unnatural reproduction was obtained.
- D: Natural redness was slightly lacking.

(3) Green Reproducibility
- A: Bright and vivid reproduction was obtained.
- B: Vivid reproduction was obtained.
- C: Slightly dull green was obtained.
- D: Dull green was predominant.

(4) Print Reproducibility
- A: No difference between the prints was noted.
- B: Slight difference was noted, but both were handled as the same prints.
- C: Some obvious differences were noted.
- D: Difference between the prints was clearly noted, and it was problematic in practice.

The above results are shown in the following table. All samples of this invention exhibited superior performances in clarity of thin lines and text, flesh color reproducibility, green vegetation reproducibility, and print reproducibility.

| Sample No. | Clarity of thin lines and text | Flesh color repro-ducibility | Vegetation green repro-ducibility | Print reproducibility | Remarks |
|---|---|---|---|---|---|
| 101 | D | D | D | D | Comp. |
| 102 | D | C | C | D | Comp. |
| 103 | D | C | C | D | Comp. |
| 104 | D | D | D | C | Comp. |
| 105 | B | B | B | B | Inv. |
| 106 | B | B | B | B | Inv. |
| 107 | A | A | B | B | Inv. |
| 108 | A | A | A | A | Inv. |
| 109 | A | A | A | A | Inv. |
| 110 | A | A | A | A | Inv. |
| 111 | A | B | B | B | Inv. |
| 112 | A | B | B | B | Inv. |
| 113 | A | B | B | B | Inv. |
| 114 | A | A | A | A | Inv. |
| 115 | B | B | A | B | Inv. |
| 116 | B | A | B | B | Inv. |
| 117 | B | A | B | B | Inv. |
| 118 | B | A | B | B | Inv. |
| 119 | A | B | A | B | Inv. |
| 120 | B | B | B | B | Inv. |
| 121 | A | A | A | A | Inv. |

Example 3

Printed images were obtained from processed negative images using Konicacolor New Centuria 400, the processed positive images of Konicacolor Sinbi 200 High. Quality, and the pictured image data captured using a digital camera of Digital Revio KD-200Z, manufactured by Konica Corp. The samples prepared in Example 1 were structured to be 127 mm width rolls, and were subjected to exposure and processing employing Degital Minilab System QD-21 Super (a QDP-1500 Super print processor of QDP-1500Super, and a Ecojet-HQA-P processing chemical), manufactured by Konica Corp. Evaluation was conducted in the same manner as Example 2, results of which are shown in the following table. As Example 2, the samples of this invention also exhibited excellent results.

| Sample No. | Clarity of thin lines and text | Flesh color repro-ducibility | Vegetation green repro-ducibility | Print reproducibility | Remarks |
|---|---|---|---|---|---|
| 101 | D | D | D | D | Comp. |
| 102 | D | C | C | D | Comp. |
| 103 | D | C | C | D | Comp. |
| 104 | D | D | D | C | Comp. |
| 105 | B | B | B | B | Inv. |
| 106 | B | B | B | B | Inv. |
| 107 | A | A | B | B | Inv. |
| 108 | A | A | A | A | Inv. |
| 109 | A | A | A | A | Inv. |
| 110 | A | A | A | A | Inv. |

-continued

| Sample No. | Clarity of thin lines and text | Flesh color repro-ducibility | Vegetation green repro-ducibility | Print reproducibility | Remarks |
|---|---|---|---|---|---|
| 111 | B | B | A | B | Inv. |
| 112 | B | B | A | B | Inv. |
| 113 | B | B | A | B | Inv. |
| 114 | A | A | A | A | Inv. |
| 115 | B | B | A | B | Inv. |
| 116 | B | A | B | B | Inv. |
| 117 | B | A | B | B | Inv. |
| 118 | B | A | B | B | Inv. |
| 119 | A | B | A | B | Inv. |
| 120 | B | B | B | B | Inv. |
| 121 | A | A | A | A | Inv. |

INDUSTRIAL APPLICABILITY

As described above, based on the present invention, it is possible to provide a silver halide photographic material having high sensitivity, low fogging, excellent gradation, good storage stability, and high pressure resistance while exhibiting superiority in reproduction of text and colors, even employing various digital exposure apparatuses employing different light sources and exposure methods, and a method for forming an image using the same.

The invention claimed is:

1. A silver halide photographic material, comprising a support having thereon a silver halide emulsion layer, the silver halide emulsion layer containing a binder and silver halide particles having a silver chloride content of more than or equal to 90 mol %, wherein a compound represented by Formula (S) is contained in an interior portion and on a surface of the silver halide particles and in a binder of the silver halide emulsion layer, and the silver halide particles have two or more silver halide phases therein each having a different concentration of the compound represented by Formula (S), Formula (S)

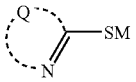

wherein Q is a 5- or 6-membered nitrogen containing heterocyclic ring, M is a hydrogen atom, an alkaline metal atom or a group being necessary to form a mono-valent cation.

2. The silver halide photographic material of claim 1, wherein in the interior portion of the silver halide articles, a silver halide phase having lower concentration of the compound represented by Formula (S) than another silver halide phase having maximum concentration of the compound represented by Formula (S), is on the outside of the silver halide phase having maximum concentration of the compound represented by Formula (S).

3. The silver halide photographic material of claim 1, wherein the compound represented by Formula (S) is a compound represented by Formula (S-2):

Formula (S-2)

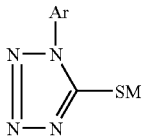

wherein Ar is a group represented by the following formulas;

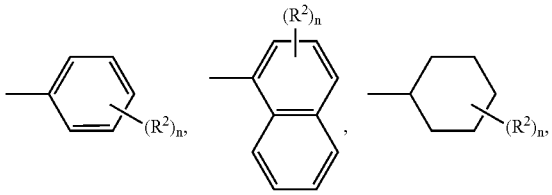

$R^2$ is an alkyl group, an alkoxy group, a carboxyl group or a salt thereof, a sulfo group or a salt thereof, a hydroxyl group, an amino group, an acylamino group, a carbamoyl group or a sulfonamide group, n is an integer of 0 to 2, and M is the same as M in Formula (S).

4. The silver halide photographic material of claim 1, wherein a pH of a surface of the silver halide emulsion layer is 4 to 7.

5. A method for forming an image, comprising the steps of:

exposing the silver halide photographic material of claim 1 with a scanning exposure method; and conducting color developing process to the exposed photographic material.

6. The silver halide photographic material of claim 2, wherein the compound represented by Formula (S) a compound represented by Formula (S-2):

Formula (S-2)

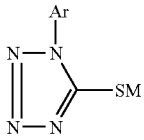

wherein Ar is a group represented by the following formulas;

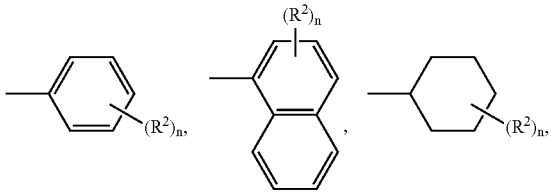

$R^2$ is an alkyl group, an alkoxy group, a carboxyl group or a salt thereof, a sulfo group or a salt thereof, a hydroxyl group, an amino group, an acylamino group, a carbamoyl group or a sulfonamide group, n is an integer of 0 to 2, and M is the same as M in Formula (S).

7. The silver halide photographic material of claim 2, wherein a pH of a surface of the silver halide emulsion layer is 4 to 7.

8. The silver halide photographic material of claim 3, wherein a pH of a surface of the silver halide emulsion layer is 4 to 7.

9. The method for forming an image, comprising the steps of exposing the silver halide photographic material of claim 2 with a scanning exposure method; and conducting color developing process to the exposed photographic material.

10. A method for forming an image, comprising the steps of:

exposing the silver halide photographic material of claim 3 with a scanning exposure method, and conducting color developing process to the exposed photographic material.

11. A method for forming an image, comprising the steps of:

exposing the silver halide photographic material of claim 6 with a scanning exposure method; and conducting color developing process to the exposed photographic material.

12. A method for forming an image, comprising the steps of:

exposing the silver halide photographic material of claim 4 with a scanning exposure method, and conducting color developing process to the exposed photographic material.

13. A method for forming an image, comprising the steps of:

exposing the silver halide photographic material of claim 7 with a scanning exposure method, conducting color developing process to the exposed photographic material.

14. A method for forming an image, comprising the steps of:

exposing the silver halide photographic material of claim 8 with a scanning exposure method; and conducting color developing process to the exposed photographic material.

15. The silver halide photographic material of claim 2, wherein the compound represented by Formula (S) is a compound represented by Formula (S-2):

Formula (S-2)

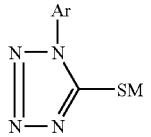

wherein Ar is a group represented by the following formulas;

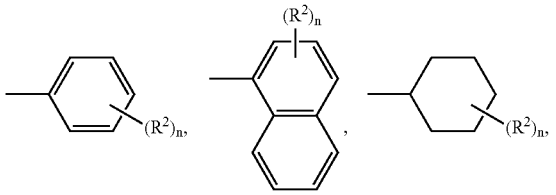

$R^2$ is an alkyl group, an alkoxy group, a carboxyl group or a salt thereof, a sulfo group or a salt thereof, a hydroxyl group, an amino group, an acylamino group, a carbamoyl group or a sulfonamide group, n is an integer of 0 to 2, and M is the same as M in Formula (S).

* * * * *